US012631393B2

(12) United States Patent
Butts

(10) Patent No.: US 12,631,393 B2
(45) Date of Patent: May 19, 2026

(54) SYSTEM AND METHOD FOR SEPARATING METHANE AND NITROGEN WITH REDUCED HORSEPOWER DEMANDS

(71) Applicant: BCCK Holding Company, Midland, TX (US)

(72) Inventor: Rayburn C. Butts, Midland, TX (US)

(73) Assignee: BCCK Holding Company, Midland, TX (US)

( * ) Notice: Subject to any disclaimer, the term of this patent is extended or adjusted under 35 U.S.C. 154(b) by 0 days.

(21) Appl. No.: 18/129,630

(22) Filed: Mar. 31, 2023

(65) Prior Publication Data

US 2023/0235955 A1 Jul. 27, 2023

Related U.S. Application Data

(63) Continuation of application No. 16/852,770, filed on Apr. 20, 2020, now Pat. No. 11,650,009, which is a (Continued)

(51) Int. Cl.
*F25J 3/02* (2006.01)

(52) U.S. Cl.
CPC ..... *F25J 3/0257* (2013.01); *F25J 3/0209* (2013.01); *F25J 2200/06* (2013.01);

(Continued)

(58) Field of Classification Search
CPC ..... F25J 3/0257; F25J 3/0209; F25J 2200/06; F25J 2200/40; F25J 2200/50;

(Continued)

(56) References Cited

U.S. PATENT DOCUMENTS 2,487,147 A * 11/1949 Latchum, Jr. ..... F25J 3/0209 208/355
4,323,380 A 4/1982 Mueller et al.

(Continued)

FOREIGN PATENT DOCUMENTS

DE 2962561 2/1981
EP 1065457 1/2001

(Continued)

OTHER PUBLICATIONS

Weidert et al., Integrated System The Key to Unlocking Gas Processing, Chart Energy and Chemicals, Inc., pp. 1-9.

(Continued)

*Primary Examiner* — Joel M Attey
*Assistant Examiner* — Brahim A. Michael Adeniji
(74) *Attorney, Agent, or Firm* — Scheef & Stone, LLP; Robin L. Barnes

(57) ABSTRACT

A system and method for removing nitrogen from natural gas using two fractionating columns, that may be stacked, and a plurality of separators and heat exchangers, with horsepower requirements that are 50-80% of requirements for prior art systems. The fractionating columns operate at different pressures. A feed stream is separated with a vapor portion feeding the first column to produce a first column bottoms stream that is split into multiple portions at different pressures and first column overhead stream that is split or separated into two portions at least one of which is sub-cooled prior to feeding the top of the second column. Optional heat exchange between first column and second column streams provides first column reflux and reboil heat for a second column ascending vapor stream. Three sales gas streams are produced, each at a different pressure.

51 Claims, 3 Drawing Sheets

Related U.S. Application Data continuation-in-part of application No. 16/714,110, filed on Dec. 13, 2019, now Pat. No. 11,378,333.

(52) U.S. Cl.
CPC ..... *F25J 2200/40* (2013.01); *F25J 2200/50* (2013.01); *F25J 2200/72* (2013.01); *F25J 2200/78* (2013.01); *F25J 2205/04* (2013.01); *F25J 2240/12* (2013.01); *F25J 2245/00* (2013.01); *F25J 2270/12* (2013.01)

(58) Field of Classification Search
CPC .. F25J 2200/72; F25J 2200/78; F25J 2205/04; F25J 2240/12; F25J 2245/00; F25J 2270/12; F25J 2200/04; F25J 2200/52; F25J 2205/02; F25J 2270/02; F25J 3/0233; F25J 3/0238; C10L 3/10; C10L 3/104; B01D 3/143; B01D 3/322
See application file for complete search history.

(56) References Cited

U.S. PATENT DOCUMENTS

| | | | | |
|---|---|---|---|---|
| 4,331,461 | A | 5/1982 | Karbosky et al. | |
| 4,411,677 | A | 10/1983 | Pervier et al. | |
| 4,451,275 | A | 5/1984 | Vines et al. | |
| 4,474,591 | A | 10/1984 | Arand et al. | |
| 4,547,209 | A | 10/1985 | Netzer | |
| 4,609,390 | A | 9/1986 | Wilson | |
| 4,936,888 | A * | 6/1990 | DeLong | F25J 3/0257 62/622 |
| 4,948,405 | A | 8/1990 | Thompson | |
| 5,041,149 | A | 8/1991 | Handley | |
| 5,051,120 | A | 9/1991 | Pahade et al. | |
| 5,141,544 | A | 8/1992 | Butts | |
| 5,257,505 | A | 11/1993 | Butts | |
| 5,375,422 | A | 12/1994 | Butts | |
| 5,617,741 | A * | 4/1997 | McNeil | F25J 3/0257 62/622 |
| 6,116,051 | A | 9/2000 | Agrawal et al. | |
| 6,205,813 | B1 | 3/2001 | Shah et al. | |
| 7,520,143 | B2 | 4/2009 | Spilsbury | |
| 8,522,574 | B2 | 9/2013 | Crawford et al. | |
| 8,640,495 | B2 | 2/2014 | McNeil | |
| 8,869,553 | B2 | 10/2014 | Court et al. | |
| 9,816,752 | B2 | 11/2017 | Butts | |
| 9,920,986 | B2 | 3/2018 | Mak | |
| 2004/0177646 | A1 | 9/2004 | Wilkinson et al. | |
| 2004/0237581 | A1 | 12/2004 | Paradowski | |
| 2007/0180855 | A1 * | 8/2007 | Butts | F25J 3/0257 62/620 |
| 2008/0302650 | A1 * | 12/2008 | Bello | F25J 3/0209 203/25 |
| 2010/0223950 | A1 | 9/2010 | Malsam | |
| 2011/0289963 | A1 | 12/2011 | Price | |
| 2012/0024690 | A1 | 2/2012 | Betting et al. | |
| 2012/0097520 | A1 * | 4/2012 | Johnson | F25J 3/0238 203/91 |
| 2012/0324943 | A1 * | 12/2012 | Butts | F25J 3/0238 62/630 |
| 2014/0013797 | A1 | 1/2014 | Butts | |
| 2015/0052938 | A1 | 2/2015 | Bauer et al. | |
| 2018/0031314 | A1 | 2/2018 | Butts | |
| 2018/0231306 | A1 * | 8/2018 | Butts | F25J 3/0257 |

FOREIGN PATENT DOCUMENTS

| | | |
|---|---|---|
| GB | 2208699 | 4/1989 |
| GB | 2298034 | 8/1996 |
| RU | 2121637 | 11/1998 |
| WO | WO2009144423 | 12/2009 |

OTHER PUBLICATIONS

Weidert et al., Holding the Key Article, Hydrocarbon Engineering, Reprinted from Aug. 2016, https://files.chartindustries.com/HoldintheKey-NewsArticle.pdf, retrieved from the Internet Nov. 12, 2019.

* cited by examiner

SYSTEM AND METHOD FOR SEPARATING METHANE AND NITROGEN WITH REDUCED HORSEPOWER DEMANDS

CROSS REFERENCE TO RELATED APPLICATION

This application is a continuation of U.S. application Ser. No. 16/852,770, filed Apr. 20, 2020, which issued as U.S. Pat. No. 11,650,009 on May 16, 2023, which is a continuation-in-part of U.S. application Ser. No. 16/714,110, filed Dec. 13, 2019, which issued as U.S. Pat. No. 11,378,333 on Jul. 5, 2022.

BACKGROUND OF THE INVENTION

1. Field of the Invention

This invention relates to systems and methods for separating nitrogen from methane and other components from natural gas streams of around 20 MMSCFD or more with reduced energy/horsepower requirements compared to prior art systems and methods.

2. Description of Related Art

Nitrogen contamination is a frequently encountered problem in the production of natural gas from underground reservoirs. The nitrogen may be naturally occurring or may have been injected into the reservoir as part of an enhanced recovery operation. Transporting pipelines typically do not accept natural gas containing more than 4 mole percent inerts, such as nitrogen. As a result, the natural gas feed stream is generally processed to remove such inerts for sale and transportation of the processed natural gas.

One method for removing nitrogen from natural gas is to process the nitrogen and methane containing stream through a Nitrogen Rejection Unit or NRU. The NRU may be comprised of two cryogenic fractionating columns, such as that described in U.S. Pat. Nos. 4,451,275 and 4,609,390. These two column systems have the advantage of achieving high nitrogen purity in the nitrogen vent stream, but require higher capital expenditures for additional plant equipment, including the second column, and may require higher operating expenditures for refrigeration horsepower and for compression horsepower for the resulting methane stream.

The NRU may also be comprised of a single fractionating column, such as that described in U.S. Pat. Nos. 5,141,544, 5,257,505, and 5,375,422. Many single column systems have a single sales gas stream exiting the NRU fractionating column, usually at a lower pressure requiring compression to meet pipeline requirements. For example, in U.S. Pat. No. 5,141,544, an NRU feed stream is first processed to remove water and carbon dioxide (to avoid freezing problems associated in carbon dioxide) and is then split into three portions prior to feeding the single column NRU. A first portion is cooled through heat exchange with an overhead stream from the NRU column, a second portion is cooled through heat exchange with the NRU column bottoms stream, and a third portion is cooled through heat exchange with a side stream withdrawn from and returned to the NRU column in a reboiler for the NRU column. The first, second and third portions of the feed stream are recombined, the recombined stream is further cooled through heat exchange with the NRU column bottoms stream, and then passes through a JT valve prior to feeding into the NRU column as a liquid and vapor mixed phase stream around −215° F. and around 170 psia. The overhead stream from the single column NRU is the nitrogen vent stream. The single NRU bottoms stream is a sales gas stream at a pressure around 60 psia in the example in the '544 patent, requiring further compression.

Some single column systems also split the NRU column bottoms stream into two streams to allow for additional heat exchange with other process streams and resulting in two sales gas streams at different pressures. For example, in U.S. Pat. No. 5,375,422, an NRU feed stream is first processed to remove water and carbon dioxide and is then split into four portions prior to feeding the single column NRU. A first portion is cooled through heat exchange with an overhead stream from the NRU column; a second portion is cooled through heat exchange with a first portion of the NRU column bottoms stream after passing through the NRU column reboiler, then an internal reflux condenser in the NRU column, and then back through the reboiler; and a third portion is cooled through heat exchange with a second portion of a bottoms stream from the NRU column. The first, second and third portions of the feed stream are recombined and the recombined stream passes through a JT valve prior to feeding into the NRU column as a liquid and vapor mixed phase stream between −60 and −150° F. and around 315 psia. The fourth portion of the feed stream is cooled through two separate heat exchanges, each with a side stream withdrawn from and returned to the NRU column, before passing through a JT valve and feeding into the NRU column as a liquid and vapor mixed stream between −200 and −250° F. and around 315 psia. The fourth portion of the feed stream feeds into the NRU column at a location that is several trays above the recombined first, second, and third portions. The overhead stream from the single column NRU is the nitrogen vent stream. The NRU bottoms stream is split into the first and second portions, each of which is processed differently to achieve the desired heat exchange with other process streams. The different processing of the two portions of the NRU bottoms stream results in two sales gas streams, one at a pressure of around 20 psia and the other at a pressure around 300 psia. Such a single tower system producing only two sales gas streams, the horsepower per inlet MMSCF generally runs around 100 to 110 HP/MMSCF.

Compared to two column systems, these single column systems have the advantage of reduced capital expenditures on equipment, including elimination of the second column, and reduced operating expenditures because no external refrigeration equipment is necessary. However, they can also have higher operating expenditures related to energy/horsepower requirements. Many single column systems have horsepower requirements of around 110 HP/MMSCF of inlet feed, particularly for such systems with a single sales gas stream from the NRU column. The HP/MMSCF is improved with prior art single column systems that produce three sales gas streams at differing pressures, typically requiring between 80 and 90 HP/MMSCF. Similarly, prior art conventional two column systems producing a single sales gas stream (such as the '544 patent), the horsepower requirements generally run around 80 to 90 HP/MMSCF of inlet feed. In addition to capital and operating expenditures, many prior NRU systems have limitations associated with processing NRU feed streams containing high concentrations of carbon dioxide. Nitrogen rejection processes involve cryogenic temperatures, which may result in carbon dioxide freezing in certain stages of the process causing blockage of process flow and process disruption. Carbon dioxide is typically removed by conventional methods from the NRU feed stream, to a maximum of approximately 35 parts per million (ppm) carbon dioxide, to avoid these issues. There is a need for a system and method to efficiently separate nitrogen from methane and other components in natural gas streams with reduced energy/horsepower requirements and preferably with the capability to process feed streams with higher concentrations of carbon dioxide.

SUMMARY OF THE INVENTION

The systems and methods disclosed herein facilitate the economically efficient removal of nitrogen from methane with substantially reduced energy/horsepower requirements. The systems and methods are particularly suitable for feed gas flow rates of around 20 MMSCFD or more and having nitrogen contents ranging from 5 mol % to 50 mol %. The systems and methods are also capable of processing feed gas containing concentrations of carbon dioxide up to approximately 100 ppm for typical nitrogen levels between 5-50%. The systems and methods have horsepower requirements that are around 50-60% of the horsepower requirements for most prior art single column NRU systems with a single sales gas stream.

According to one preferred embodiment of the invention, a system and method are disclosed for processing an NRU feed gas stream containing primarily nitrogen and methane through two fractionating columns to produce three processed sales gas streams, each at a different pressure, which may be further compressed as needed to be meet transporting pipeline requirements (typically around 615 psia). Most preferably, one sales gas stream is a high pressure stream having a pressure between 315-465 psia (more preferably between 365-415 psia), a second sales gas stream is an intermediate pressure stream having a pressure between 75-215 psia (more preferably between 115-215 psia), and a third sales gas stream is a low pressure stream having a pressure between 45-115 psia (more preferably between 50-115 psia). An inlet feed stream is preferably separated in a first separator into an overhead stream that feeds into a first stage column and a bottoms liquid stream that may be sent for further processing to recover remaining methane and NGL components. The first stage column is designed as a high pressure NRU column to remove the bulk of the incoming nitrogen from the methane and heavier hydrocarbon components, while the second stage column is operated at a lower pressure. The feed streams to the first stage NRU column and the first stage overhead stream are not cooled to traditional targeted temperatures of −200 to −245 degrees F. This allows the preferred systems and methods of the invention to feed the first column at a warmer temperature than prior art systems, which increases $CO_2$ tolerance in the feed stream. The first column also operates at a higher pressure (preferably around 315-415 psia) compared to prior art systems. The second column operates at a lower pressure (preferably around 65-115 psia).

According to another preferred embodiment, a bottoms stream from the first column is split into at least three portions. A first portion is the high pressure sales gas stream, a second portion is the intermediate pressure sales gas stream, and a third portion is at least part of the low pressure sales gas stream. Most preferably, each of the first, second, and third portions are expanded and cooled to varying degrees.

According to another preferred embodiment, the feed stream is preferably cooled in a first heat exchanger prior to feeding the first separator through heat exchange with the first separator bottoms stream, the first, second, and third portions of the first column bottoms stream, the second separator bottoms stream (which is preferably mixed with the third portion of the first column bottoms stream upstream of the first heat exchanger), and the second column overhead stream. According to another preferred embodiment, the first separator overhead stream is split into two portions, a first portion of which is recycled back through the first heat exchanger to be further cooled prior to feeding the first column. A second portion is cooled and provides reboil heat to a reboiler for the first column prior to feeding the first column. According to another preferred embodiment, the first portion of the first separator overhead stream feeds into an upper tray of the first column as a liquid with a lower temperature and lower pressure than the second portion of the first separator overhead stream that feeds into a mid-level tray of the first column, preferably as a mixed liquid-vapor stream.

According to another preferred embodiment, a bottoms stream from the second column is routed through a second heat exchanger where a specific amount of heat is added created a vapor phase. The resulting vapor and liquid are separated in a second separator. Preferably, an overhead stream from the second separator feeds back into the bottom of the second column as an ascending vapor stream. Preferably, a bottoms stream from the second separator is mixed with the third portion of the first column bottoms stream to form the low pressure sales gas stream. According to yet another preferred embodiment, the second separator bottoms stream is warmed in a second heat exchanger prior to being mixed with the third portion of the first column bottoms stream. Most preferably, the second separator is located near grade elevation level to allow for instrumentation critical for optimal operation and for maintenance to be easily accessible.

According to another preferred embodiment, which is particularly beneficial when used with feed streams having around 20% or more nitrogen, the system and method comprises one or more of the following components, configurations, or steps, most preferably each of the following components, configurations, or steps:

(1) The first column bottoms stream is split into four portions and the fourth portion is mixed with the second column bottoms stream upstream of the second separator and the mixed stream is separated in the second separator into the second separator overhead stream and the second separator bottoms stream.

(2) The second separator bottoms stream is warmed in the second heat exchanger through heat exchange with the first column overhead stream and the second column overhead stream.

(3) The pressure differential between the two columns allows for efficient energy sharing between the columns, including through heat exchange between first and second column streams to provide reflux to the first column and reboil heat to the second column. Most preferably a shell and tube style heat exchanger is used, which provides the same function as an internal knock-back condenser, but with the flexibility of two independent pieces of equipment, to provide reflux to the top of the first stage column and reboil heat to the bottom of the second stage column. A stream from a top of the first column feeds into a tube side of the heat exchanger, with a liquid portion returning to the column and a vapor portion exiting the column as the first column overhead stream. Most preferably, the second column bottoms stream is split into two portions, a first portion of the second column bottoms stream is the refrigerant that enters the shell side of the heat exchanger, where it is warmed to a vapor stream that is then mixed with a second portion of the second column liquid bottoms stream (and preferably, the fourth portion of the first column bottoms stream) prior to feeding into the second separator. The second separator overhead stream feeds back into the second column as an ascending vapor stream. According to one preferred embodiment, the two columns are erected independently, most preferably with at least part of the second column being located at an elevation higher than the first column and the heat exchanger being at least partially elevated relative to the first column so that the portion of the second column bottoms stream may feed into the shell side of the heat exchanger by gravity feed. According to another preferred embodiment, the first and second stage columns may be stacked with the second column above the first column, effectively into a single column, as will be understood by those of ordinary skill in the art. According to another preferred embodiment, the two columns may be erected inside a cold box, but a cold box is not required.

(4) The first column overhead stream is cooled upstream of feeding the second column in a second heat exchanger through heat exchange with the second separator bottoms stream and the second column overhead stream.

(5) The cooled first column overhead stream passes through a third separator or flash drum downstream of the second heat exchanger to allow a desired amount of vapor from the cooled first column overhead stream to pass through a third heat exchanger to further cool the stream and condense it prior to feeding a top of the second column. This additional cooling results from heat exchange with the second column overhead stream in the third heat exchanger. Preferably, the amount of vapor withdrawn from the third separator is controlled to achieve the desired heat balance in the third heat exchanger. Most preferably, the remaining vapor from the cooled first column overhead stream exits the third separator and is combined with the liquid portion of the stream exiting the third separator to feed into a middle section of the second column.

(6) The second column overhead stream is the nitrogen vent stream and is warmed in the third heat exchanger through heat exchange with the third separator overhead stream. The second column overhead stream is preferably then warmed again (downstream of the third heat exchanger) in the second heat exchanger through heat exchange with the second separator bottoms stream and first column overhead stream. The second column overhead stream is then preferably then warmed again (downstream of the second heat exchanger) in the first heat exchanger.

According to another preferred embodiment, which is particularly beneficial when used with feed streams having around 20% or less nitrogen, the system and method comprises one or more of the following components, configurations, or steps, most preferably each of the following components, configurations, or steps:

(1) The first column bottoms stream is preferably split into three portions, none of which feed into the second separator. Only the second column bottoms stream feeds into the second separator.

(2) The second separator bottoms stream is warmed in a second heat exchanger through heat exchange with the second column bottoms stream (upstream of feeding the second separator) and the first portion of the first column overhead stream.

(3) There is preferably a shell and tube style heat exchanger used to provide reflux to the first column, but the refrigerant is provided by a third portion of the first column bottoms stream (not the second column bottoms stream as in other preferred embodiments). A stream from a top of the first column feeds into a tube side of the heat exchanger, with a liquid portion returning to the column and a vapor portion exiting the column as the first column overhead stream. A third portion of the first column bottoms stream (refrigerant) feeds into the shell side of the heat exchanger where it is warmed and then combined with a bottoms stream from the second separator to form the low pressure sales gas stream. By controlling the amount of refrigerant that feeds into the shell side of the heat exchanger, effective control of the concentration of nitrogen exiting the first column overhead stream (and subsequently feeding into the second column) is achieved, which in turn aids in controlling the amount of methane exiting the second column overhead stream (which becomes the nitrogen vent stream). The effectiveness of the second column largely depends on the nitrogen content feeding the second column and the reflux provided to the second column (discussed further below).

(4) The first column overhead stream is split into two portions prior to feeding into the second column. According to this preferred embodiment, a third separator or flash drum is not needed for the first column overhead stream. Preferably, a first portion is cooled in a second heat exchanger through heat exchange with the second separator bottoms stream and the with the second column bottoms stream (upstream of feeding the second separator). The cooled first portion preferably feeds into a mid-level tray of the second column.

(5) Preferably, a second portion of the first column overhead stream is subcooled in a third heat exchanger through heat exchange with the second column overhead stream. The second portion preferably feeds into a top level tray of the second column as a liquid, providing reflux to the second column. The second column overhead stream is also preferably cooled upstream of the third heat exchanger through a valve or an expander. Again, the effectiveness of the second column largely depends on the nitrogen content feeding the second column, with a higher nitrogen content resulting in more reflux provided to the second column, which achieves a "cleaner" second column overhead stream (having more nitrogen and less methane). The combination of the heat exchanger to provide first column reflux described in (3) above, the cooling of the second column overhead stream in the control valve/expander and the associated third heat exchanger, achieves improvements in reducing the amount of methane in the second column overhead stream in this preferred embodiment. When the nitrogen feeding into the second column is higher, the amount of cooling from the valve/expander and third heat exchanger combination (the valve/expander cools the second overhead stream, which then subcools a portion of the first column overhead stream feeding into a top of the second column in the third heat exchanger) is higher relative to the amount of heat added in the second heat exchanger (effectively acting as a reboiler for the second column), which results in more reflux to the second column and a "cleaner" overhead nitrogen vent stream.

(6) The second column overhead stream is the nitrogen vent stream and is warmed in the third heat exchanger through heat exchange with the second portion of the first column overhead stream. The second column overhead stream is then warmed again (downstream of the third heat exchanger) in the first heat exchanger and preferably does not pass through the second heat exchanger.

The primary advantage of the preferred embodiments of the systems and methods disclosed herein is substantially reduced energy/horsepower requirements compared to prior art single column systems. By splitting a bottoms stream from the first column into three separate sales gas streams, each at a different pressure, with the low pressure stream preferably between 45 to 115 psia, preferred embodiments of the system and method can achieve a substantial reduction in energy/horsepower requirements to around 55 to 75 HP/MMSCF of inlet feed. Many single column prior art systems having a single sales gas stream exiting the NRU column or even two sales gas streams have horsepower requirements of around 110 HP/MMSCF of inlet feed. The horsepower requirements are reduced in many prior art conventional two column systems producing a single gas stream to around 80 to 90 HP/MMSCF of inlet feed. The horsepower requirements are similarly reduced in many prior art single column systems that produce three sales gas streams at differing pressures to around 80 to 90 HP/MMSCF of inlet feed. However, a further reduction to around 55 to 75 HP/MMSCF of inlet feed is achievable according to preferred embodiments of the systems and methods of the invention.

For inlet feed conditions like those in the computer simulation Example 1 described below, a prior art single column design with the NRU bottoms stream split into two streams at different pressures (like in the '422 patent) would require around 11,000 hp (or around 110 hp per inlet feed MMSCF of gas); however, a preferred embodiment of the invention as shown in FIG. 1 or FIG. 2 can process that inlet gas feed stream using only 6,650 hp—a difference of more than 4,350 hp. These differences equate to around $4,300,000 in installed cost plus the added fuel demand and lower associated emissions that are saved using a preferred embodiment of the invention over prior art single column designs. The operating cost savings over the capital cost differential between a prior art single column and two column system according to a preferred embodiment of the invention as shown in FIG. 1 or FIG. 2 would be around 25% of the total installed costs. One of the aspects that results in the lower energy/horsepower requirements is the availability of three sales gas streams, each at a different pressure level, exiting the NRU first column. The pressure levels of the three streams is higher than prior art systems that split the NRU column bottoms stream into two or three sales streams. For example, in U.S. Pat. No. 9,816,752 the NRU column bottoms stream is split into three streams—a low pressure sales stream at around 15 psia, an intermediate pressure sales stream at around 111-132 psia, and a high pressure sales stream at around 248-271 psia and requires more HP/MMSCF of inlet feed than preferred embodiments of the systems and methods herein where the pressures of the three sales streams (particularly the low pressure sale stream) are higher. For example, a low pressure sales stream according to the invention may have a pressure of around 55 psia (as in Example 1) or 70 psia (as in Example 2) compared to around 15 psia in the '752 patent. Although this does not seem like a large pressure difference, there is a significant difference in HP required to compress any given volume with this higher pressure. When multiple sales gas streams are produced at different pressures, they typically undergo multiple stages of compression where a lower pressure stream is compressed in a first stage and then combined with a higher pressure stream, the combined stream is then compressed in a second stage, etc. until all of the sales gas streams are recombined into a single, final sales gas stream at the desired pressure (typically around 800 psig for pipeline requirements). Most preferably, systems and methods according to the invention will allow the use of at least one less stage of compression to achieve the desired end pressure for the final sales gas stream, resulting in a substantial energy/horsepower reduction.

BRIEF DESCRIPTION OF THE DRAWINGS

The systems and methods of the invention are further described and explained in relation to the following drawings wherein.

DESCRIPTION OF THE PREFERRED EMBODIMENTS

Figure 1:
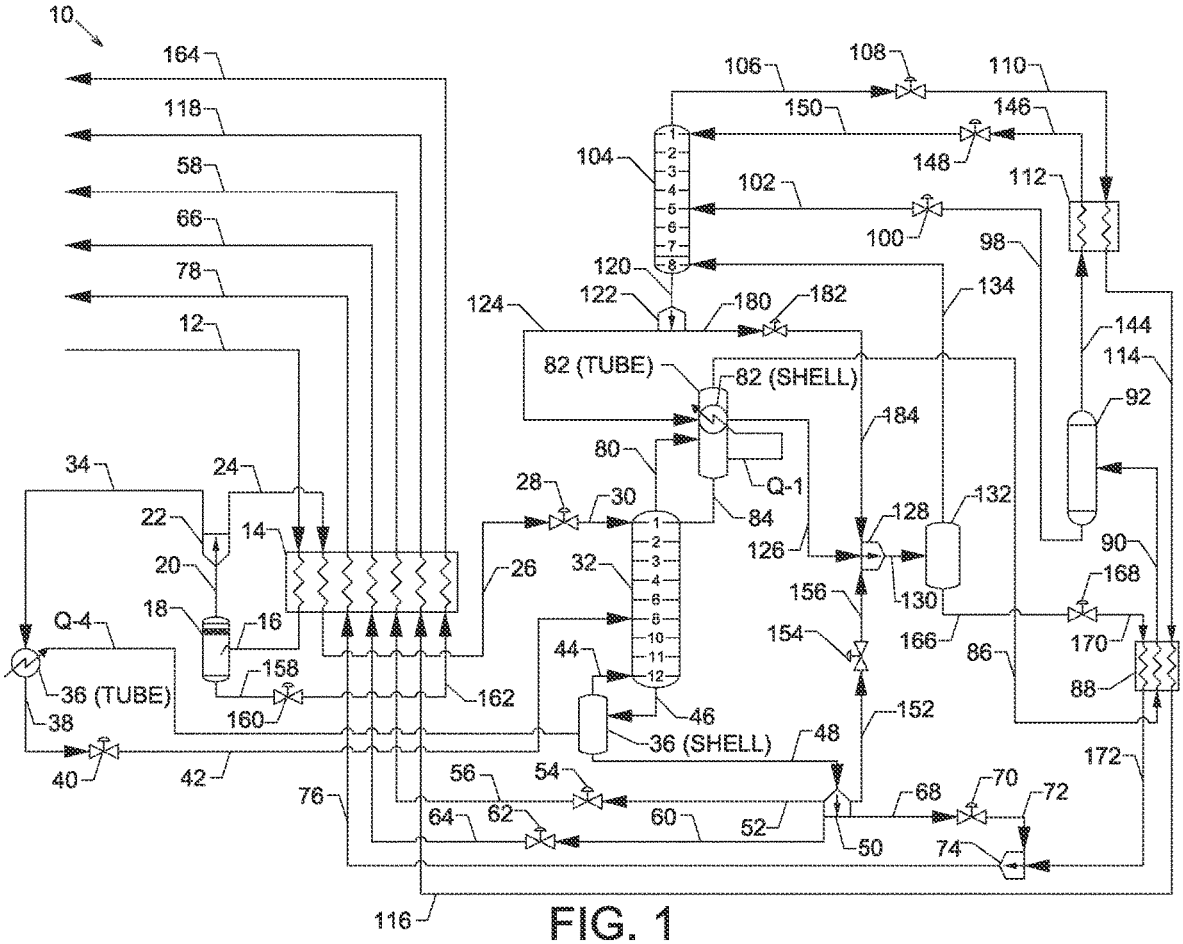
FIG. 1 is a process flow diagram illustrating a preferred embodiment of a methane and nitrogen separation system and method according to the invention.
Figure 2:
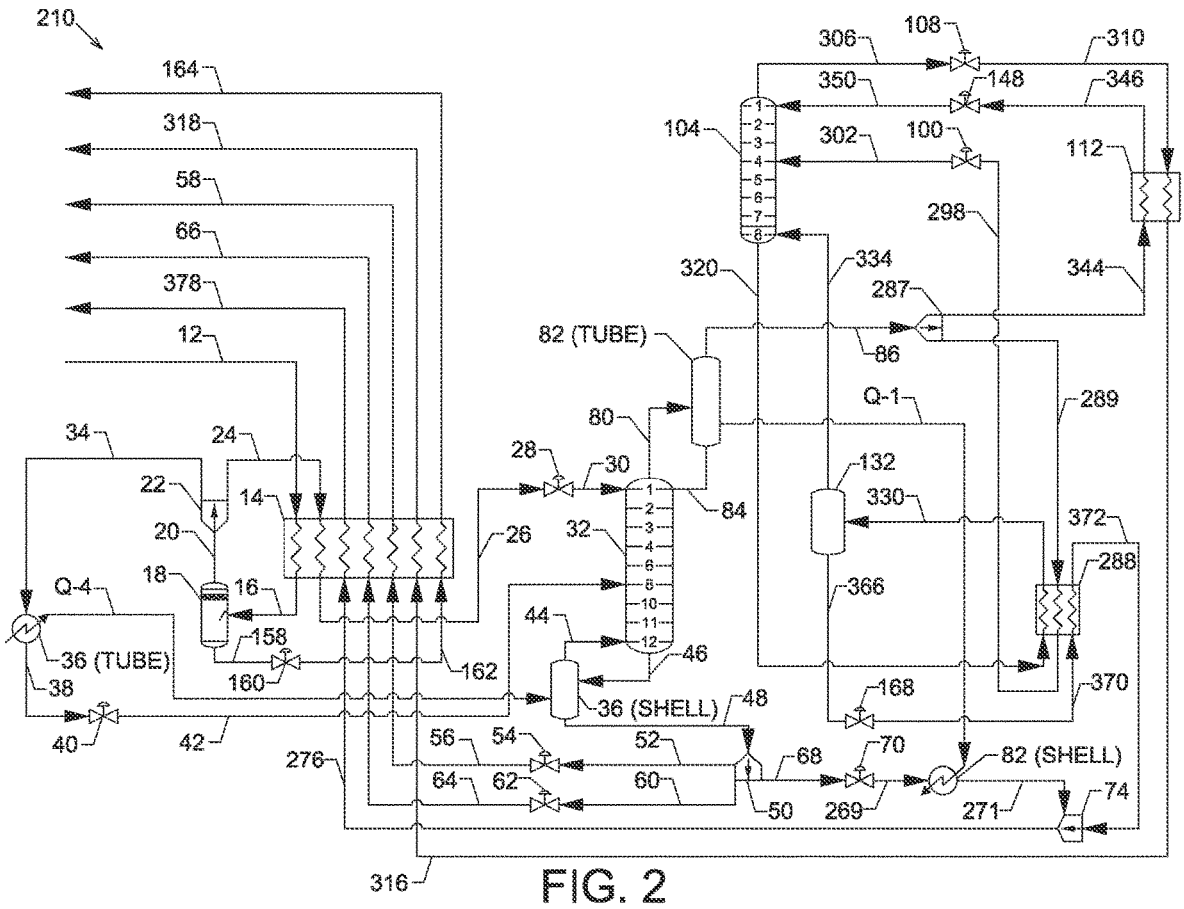
FIG. 2 is a process flow diagram illustrating another preferred embodiment of a methane and nitrogen separation system and method according to the invention.

Referring to FIG. 1, system 10 for separating nitrogen from methane from an NRU feed stream 12 according to one preferred embodiment of the invention is depicted. Referring to FIG. 2, system 210 for separating nitrogen from methane from an NRU feed stream 12 according to another preferred embodiment of the invention is depicted. System 210 is very similar to system 10 for process streams and equipment up to the point of feeding into first fractionating column 32, but differs from system 10 with processing of the overhead and bottoms streams from the first and second fractionating columns, as further described below. Where present, it is generally preferable for purposes of the present invention to remove as much of the water vapor and other contaminants from the NRU feed gas 12 as is reasonably possible prior to processing stream 12 through system 10 or system 210. It may also be desirable to remove excess amounts of carbon dioxide prior to separating the nitrogen and methane; however, the method and system are capable of processing NRU feed streams containing in excess of 100 ppm carbon dioxide without encountering the freeze-out problems associated with prior systems and methods. Methods for removing water vapor, carbon dioxide, and other contaminants are generally known to those of ordinary skill in the art and are not described herein.

In both systems 10 and 210, NRU feed stream 12 preferably comprises around 5-50% nitrogen, more preferably around 5-40% nitrogen and is at a temperature between 50-120 F, more preferably between 80-100 F, and a pressure of 450-1015 psia. Most preferably, system 10 is used when NRU feed stream 12 contains in excess of 25% nitrogen system 210 is used when NRU feed stream 12 contains less than around 20% nitrogen. Although either system 10 or 210 may be used when NRU feed stream 12 contains around 20-25% nitrogen, it is preferred to use system 210 with such feed stream nitrogen content. Feed stream 12 is preferably cooled in a first heat exchanger 14 to a temperature between 0 to −75° F. before feeding into a first separator 18 as stream 16. If stream 12 contains hydrocarbon components such that cooling to a temperature of between 0 and −75 deg F. will cause condensation of the heavier hydrocarbon components then a bottoms liquid stream 158 from first separator 18 is warmed in first heat exchanger 14 and is then sent for further processing as stream 164 to refine contained NGL components. An overhead vapor stream 20 from first separator 18 is split into streams 24 and 34. Stream 24 is recycled back through first heat exchanger 14 where it is cooled and condensed prior to passing through a JT valve 28 and then feeding into an upper level of first fractionating column 32 as liquid stream 30. Stream 34 passes through a tube side of a reboiler 36 for the first column 32 where it is cooled and partially condensed before passing through valve 40 (most preferably a throttle valve) and then feeding into a mid-to-lower level of first fractionating column 32 as mixed liquid-vapor stream 42. First column 32 is preferably operated at pressures ranging from 315-415 psia, more preferably from 325-385 psia with feed stream (streams 30 and 42) temperatures ranging from −210 to −170 F, more preferably −205 to −175 F.

In both systems 10 and 210, a liquid stream 46 from a bottom of first column 32 passes through a shell side of reboiler 36 with a vapor portion 44 returning to the bottom of column 32 and a liquid portion 48 exiting as a first column bottoms stream. Bottoms stream 48 preferably comprises around 1-4% nitrogen, more preferably 2-3% nitrogen. A vapor stream 80 from a top of first column 32 passes through a tube side 82 (tube) of a heat exchanger 82, where it is partially condensed, with a vapor portion exiting as first fractionating column overhead stream 86 and a liquid portion 84 returning to column 32. The refrigerant source for heat exchanger 82 in system 10 differs from that in system 210, as further described below. First fractionating column overhead stream 86 preferably comprises around 15-40% methane and 60-85% nitrogen.

Referring to FIG. 1, in system 10, bottoms stream 48 is preferably split into four portions: 52 (first portion), 60 (second portion), 68 (third portion), and 152 (fourth portion) in splitter 50. Each portion passes through a valve 54, 62, 70, 154 where it is partially vaporized, reducing the temperature and pressure of the exiting streams 56 (first portion), 64 (second portion), 72 (third portion), and 156 (fourth portion) to varying degrees.

In system 10, stream 56 preferably has a pressure of 325-385 psia and a temperature of −145 to −165° F. before being warmed in first heat exchanger 14 to become a high pressure sales gas stream 58. Stream 64 preferably has a pressure of 150-175 psia and a temperature of −175 to −200° F. before being warmed in first heat exchanger 14 to become an intermediate pressure sales gas stream 66. In system 10, stream 72 preferably has a pressure of 45-105 psia and a temperature of −200 to −235° F. before being mixed in mixer 74 with a bottoms stream from second separator 132 to form stream 76. Stream 76 preferably has a pressure of 45-105 psia and a temperature of −200 to −235° F. before being warmed in first heat exchanger 14 to become a low pressure sales gas stream 78.

Most preferably, in system 10, high pressure sales gas stream 58 is at a pressure between 315-415 psia, and is at a pressure higher than intermediate sales gas stream 66 and higher than low pressure sales gas stream 78. Most preferably, intermediate pressure sales gas stream 66 is at a pressure between 145-215 psia, and is at a pressure lower than high sales gas stream 58 and higher than low pressure sales gas stream 78. Most preferably, low pressure sales gas stream 78 is at a pressure between 45-105 psia, and is at a pressure lower than intermediate sales gas stream 66 and lower than high pressure sales gas stream 58. The pressures of high pressure sales gas stream 58 and lower pressure sales gas stream 78 are substantially higher than prior art systems, such as U.S. Pat. No. 9,816,752, where the bottoms stream from the NRU column is separated into multiple streams at different pressures. The pressures of the high pressure sales gas stream 58 and intermediate sales gas stream 66 are also substantially higher than other prior art systems having only a single sales gas stream from the bottoms of the NRU column, such as U.S. Pat. No. 5,141,544. Each sales gas stream preferably comprises at no more than 4% nitrogen.

In system 10, first column overhead stream 86 is cooled and partially condensed in a second heat exchanger 88, before entering a third separator or flash drum 92 as stream 90. Cooled first column overhead stream 90 is separated in third separator 92 into a primarily liquid bottoms portion 98 and a vapor overhead portion 144. The amount of vapor exiting the third separator 92 is controlled by the amount of vapor needed to achieve certain thermal conditions as dictated by the requirements of the heat exchanger 112. Specifically, the amount of vapor entering the third exchanger 112 is determined by the difference in temperature between streams 144 and 114 so that stream 114 preferably exits the third heat exchanger 112 at temperature approximately 2 to 5° F. colder than stream 144. The excess vapor, not required by the heat exchanger 112, exits the third separator 92 from the bottom of the separator with the exiting liquid as stream 98. Vapor stream 144 is then cooled and condensed in the third heat exchanger 112 prior to feeding into a top of the second column 104 as a liquid reflux stream 150. Third separator 92 is designed to allow a measured amount of vapor flow from the cooled first column overhead stream 90, to pass through third heat exchanger 112 to control subcooling stream 144 prior to feeding into the top of the second column 104 as stream 150. The amount of subcooling achieved in the third exchanger 112 is preferably approximately 40 to 80° F. This subcooling is required to cool the overhead of the second tower, stage 1, to an adequately low temperature to create reflux inside of the second column 324. This reflux is required to achieve a high degree of methane/nitrogen separation within the second column 324 and to achieve a preferred purity of nitrogen exiting the second column 324 of approximately 96-99%, most preferably at least approximately 98%. The balance of the vapor present in stream 90 and not utilized by the exchanger 112 exits the third separator along with the liquid present in stream 90 as stream 98. The two phase stream 98 then enters the expansion valve 100 where the pressure and temperature are preferably reduced 55-75 psia, more preferably around 70 psia, and a temperature of −265 to −285° F., more preferably around −275° F. respectively.

In system 10, second column 104 is preferably operated at pressures ranging from 50-115 psia, more preferably from 55-75 psia with feed stream (streams 150, 102, 134). The approximate feed temperature of stream 150 feeding the top of the second tower is approximately −295° F. The temperature feeding the intermediate feed, mid column is approximately −275° F. and the temperature feeding the column bottom is approximately −225° F. The subcooled liquid stream 150 entering the column top into tray 1 provides the required reflux for the column and the vapor entering as stream 134 provides the reflux vapor. An overhead stream 106 from the second column 104 is routed to an expansion valve 108 where the temperature and pressure are further reduced. The approximate temperature at this point is preferably −290 to −310° F., most preferably approximately −300° F. The vapor exiting the expansion valve 108 is then warmed in third heat exchanger 112, then warmed again in second heat exchanger 88, then warmed again in the first heat exchanger 14 before exiting system 10 as nitrogen vent stream 118. Nitrogen vent stream 118 preferably comprises less than 2% methane and more than 98% nitrogen.

In system 10, a liquid bottoms stream 120 from second column 104 is split in splitter 122 into two portions 124 and 180 that are later recombined, along with a fourth portion of the bottoms stream from first column 32, in mixer 128 to form stream 130, which feeds into second separator 132. A first portion of the bottoms stream from column 104, stream 124, is a refrigerant source for heat exchanger 82, being warmed in a shell side of heat exchanger 82 upstream of mixer 128. A second portion of the bottoms stream from column 104, stream 180, enters temperature control valve 182 upstream of mixer 128. The placement of this control valve 182, and the piping configuration involving streams 124, 180, 184, and 126, are important aspects to operation of system 10 in that it provides the pressure drop necessary to offset the pressure loss through the shell side of heat exchanger 82.

Stream 130 in system 10 preferably feeds into second separator 132 at a temperature −220 to −235° F. and a pressure between 50-75 psia. An additional two phase stream 156 (a partially vaporized fourth portion of the first column bottoms stream, preferably at a temperature of −220 to −210° F. and a pressure between 50-115 psia) is added to separator 132 to provide additional refrigeration as required to allow exchanger 88 to function properly. Stream 156 is preferably mixed with two portions of the bottoms stream from second column 104 in mixer 128 to form stream 130 prior to feeding into second separator 132. A vapor stream 134 exits the separator 132 and is then routed to the second column 104. Likewise, a liquid stream 166, preferably comprising less than 4% nitrogen and more preferably less than 2% nitrogen, exits the separator 132. Second column 104 preferably does not comprise a reboiler, but uses heat exchanger 82 (or condenser 482) and second separator 132 to effectively act as a reboiler with stream 134 being returned to a bottom of column 104 as an ascending vapor stream. Bottoms stream 166 from second separator 132 is then routed to level valve 168 as required to hold a desired liquid level in the separator 132. Stream 166 exits the level valve 168 as stream 170 where it then enters heat exchanger 88. Stream 170 is warmed in second heat exchanger 88 before mixing in mixer 74 with a third portion 72 of the bottoms stream from first column 32 to form low pressure sales gas stream 78.

System 10 utilizes efficient heat exchange between various process streams to improve process performance. In first heat exchanger 14, feed stream 12 and a portion 24 of an overhead stream from first separator 18 are cooled through heat exchange with first portion 56 of the first column bottoms stream, second portion 64 of the first column bottoms stream, mixed stream 76, overhead stream 116 from the second column 104 (downstream of heat exchange in second heat exchanger 88 and third heat exchanger 112) and a bottoms stream 162 from the first separator 18. The feed stream 12 is cooled in first heat exchanger 14 upstream of feeding first separator 18. The purpose of separator 18 is to provide separation of heavier hydrocarbon components such as propane, butanes and gasolines from the inlet feed stream 12 before entering the colder part of the system 10. Portion 24 is cooled in first heat exchanger 14 upstream of routing the stream to the first column 32. In second heat exchanger 88, overhead stream 86 from first column 32 is cooled through heat exchange with overhead stream 114 from second column 104 (downstream of heat exchanger in third heat exchanger 112) and bottoms stream 170 from second separator 132. Overhead stream 86 is cooled in second heat exchanger 88 prior to feeding third separator 92. In third heat exchanger 112, stream 144 from third separator 92 is subcooled through heat exchange with overhead stream 110 from second column 104. System 10 also preferably allows for heat exchange between a second portion 34 of the overhead stream from the first separator 18 and a liquid stream 46 from a bottom of column 32 in a reboiler 36. The exchanger 36 (tube) is the tube side of a shell and tube style heat exchanger used to provide the necessary heat source for the bottom of the first column 32. The exchanger depicted as 36 (shell) is the shell side of the exchanger 36.

System 10 preferably also comprises a fourth heat exchanger comprising a tube side 82 (tube) and a shell side 82 (shell), that are independent pieces of equipment configured as a vertical tube, falling film condenser. Heat exchanger 82 (tube) and 82 (shell) provide the similar function as an internal knockback condenser 482 and shown and described in connection with FIG. 3 and in U.S. Patent Application Publication 2007/0180855, incorporated herein by reference. A vapor stream 80 from a top of first column 32 passes through a tube side 82 (tube) of a heat exchanger 82 (tube), where it is partially condensed, with a vapor portion exiting as first fractionating column overhead stream 86 and a liquid portion 84 returning to column 32. The refrigerant source for heat exchanger 82 is a first portion of the bottom fluid from the second column 104, which is routed to the shell side of the exchanger 82, and the condensed liquid from first column overhead stream is designed to operate on the tube side of exchanger 82. The first portion 124 of the bottoms stream from second column 104 passes through the shell side 82 (shell), preferably by gravity feed, where heat is added resulting in a partial or total vaporization of stream 124 and exiting the exchanger 82 (shell) as stream 126. Stream 126 is then mixed with the liquid second portion of the bottoms stream from the second column 104 to form stream 130, which feeds into second separator 132. Column 104 is preferably located in an elevated position relative to column 32, and the two may be stacked together to effectively form a single column, with elevated heat exchanger 82 (or knockback condenser 482) preferably mounted between column 104 and column 32 and at least partially elevated relative to column 32. This allows gravity feed of the liquid from stream 124 through the shell side 82 (shell) of the fourth heat exchanger, like in a knockback condenser 482, so that it is not necessary to use a conventional reflux condenser that requires a pump to circulate the refrigerant liquid, which can add undesirable heat to the liquid. Utilizing fourth heat exchanger 82 (or knockback condenser 482) allows system 10 to operate with less refrigerant (horsepower) resulting in lower cost and greater flexibility. This fourth heat exchanger provides reflux to column 32 and, coupled with second separator 132, reboil heat to column 104. Although it is generally known in the prior art to use a knockback condenser, the configuration of heat exchanger 82 (shell) and 82 (tube) (or the specific knockback condenser 482 and stream flows herein), and the pressures and temperatures used in system 10, are different from the prior art. In the prior art, the knock back condenser had a single purpose, which is to remove heat from the column 32 overhead. In the configuration of exchanger 82 (or knockback condenser 482) in system 10, the purpose is twofold. As with the prior art, the exchanger 82 is still utilized to provide the removal of heat from the overhead of column 32, but the primary purpose of exchanger 82 (or knockback condenser 482) in system 10 is to provide a heat source to reboil the second column 104. In operation, the controls are adjusted to provide for the second column heat and are not designed to remove heat from the first column 32 against a specific target. The pressure difference between the two columns allows for this interchange of heat. The piping configuration to allow satisfactory operation of this exchanger 82 (or knockback condenser 482) is an important aspect of system 10 must be designed so as to allow for the correct amount of heat input into stream 124.

Referring to FIG. 2, in system 210, bottoms stream 48 is preferably split into three portions 52 (first portion), 60 (second portion), and 68 (third portion) in splitter 50. Each portion passes through a valve 54, 62, 70 where it is partially vaporized, reducing the temperature and pressure of the exiting streams 56 (first portion), 64 (second portion), and 269 (third portion) to varying degrees. Bottoms stream 48 preferably comprises around 1-4% nitrogen, more preferably 2-3% nitrogen. Stream 56 preferably has a pressure of 325-415 psia and a temperature of −145 to −165° F. before being warmed in first heat exchanger 14 to become a high pressure sales gas stream 58. Stream 64 preferably has a pressure of 150-200 psia and a temperature of −175 to −200° F. before being warmed in first heat exchanger 14 to become an intermediate pressure sales gas stream 66. Stream 269 preferably has a pressure of 55 to 115 psia and a temperature of −200 to −225° F. and is the refrigerant source for heat exchanger 82. Stream 269 is warmed in a shell side of heat exchanger 82 (shell), exiting as stream 271, which is then mixed in mixer 74 with a bottoms stream from second separator 132 to form stream 276. Stream 276 preferably has a pressure of 65 to 115 psia before being warmed in first heat exchanger 14 to become a low pressure sales gas stream 378.

Most preferably, as with system 10, high pressure sales gas stream 58 in system 210 is at a pressure between 315-465 psia (more preferably 365-415 psia), and is at a pressure higher than intermediate sales gas stream 66 and is at a pressure higher than the intermediate sale gas stream 66 and higher than than low pressure sales gas stream 378. Most preferably, intermediate pressure sales gas stream 66 in system 210 is at a pressure between 75-215 psia (more preferably 145-215 psia), and is at a pressure lower than high sales gas stream 58 and higher than low pressure sales gas stream 378. Most preferably, low pressure sales gas stream 378 in system 210 is at a pressure between 45-115 psia (more preferably 50-115 psia), and is at a pressure lower than intermediate sales gas stream 66 and lower than high pressure sales gas stream 58. The pressures of high pressure sales gas stream 58 and lower pressure sales gas stream 378 are substantially higher than prior art systems, such as U.S. Pat. No. 9,816,752, where the bottoms stream from the NRU column is separated into multiple streams at different pressures. Additionally, the pressure of low pressure sales gas stream 378 in system 210 is generally higher than low pressure sales gas stream 78 in system 10. The pressures of the high pressure sales gas stream 58 and intermediate sales gas stream 66 are also substantially higher than other prior art systems having only a single sales gas stream from the bottoms of the NRU column, such as U.S. Pat. No. 5,141,544. Each sales gas stream in system 210 preferably comprises at no more than 4% nitrogen.

In system 210, first fractionating column overhead stream 86 preferably comprises around 15-40% methane and 60-85% nitrogen. First column overhead stream 86 is split into streams 344 and 289 in splitter 287. Stream 289 is cooled and condensed in a second heat exchanger 288, before passing through expansion valve 100, exiting as mixed liquid-vapor stream 302 with a pressure preferably reduced to around 55 to 115 psia and a temperature reduced to around −265 to −300° F. Second heat exchanger 288 in system 210 is different from second heat exchanger 88 in system 10 in the number of streams absorbing heat and rejecting heat. In system 10, two of the three stream passing through second heat exchanger 88 are absorbing heat and only one is rejecting heat. In system 210, two of the three streams passing through heat exchanger 288 are rejecting heat and only one is absorbing heat. Stream 302 then feeds into a mid-level of second fractionating column 104. Stream 344 is cooled and condensed in third heat exchanger 112, exiting as stream 346. Stream 346 which passes through valve 148, reducing the pressure to become mixed liquid-vapor stream 350 prior to feeding into an upper tray level of second fractionating column 104. In the configuration of system 210, a third separator or flash drum 92 used in system 10 is not needed for overhead stream 86, saving on equipment costs. The amount of subcooling of stream 344 to stream 346 achieved in the third exchanger 112 is preferably approximately 40 to 80° F. As in system 10, this subcooling is required in system 210 to cool the overhead of the second tower, stage 1, to an adequately low temperature to create reflux inside of the second column 324. This reflux is required to achieve a high degree of methane/nitrogen separation within the second column 324 and to achieve a preferred purity of nitrogen exiting the second column 324 of approximately 96-99%, most preferably at least approximately 98%. A third stream 334 also feeds into a bottom of second fractionating column 104, as further described below.

In system 210, second column 104 is preferably operated at pressures ranging from 50-115 psia, more preferably from 55-75 psia with feed stream (streams 350, 302, 334). The approximate feed temperature of stream 350 feeding the top of the second tower is approximately −295° F. The temperature of stream 302 feeding the intermediate feed, mid column is approximately −285° F. and the temperature of stream 334 feeding the column bottom is approximately −236° F. The subcooled liquid stream 350 entering the column top into tray 1 provides the required reflux for the column and the vapor entering as stream 334 provides the reboiler vapor. An overhead stream 306 from the second column 104 is routed to an expansion valve 108 where the temperature and pressure are further reduced. The approximate temperature at this point is preferably −290 to −310° F., most preferably approximately −300° F. The vapor exiting the expansion valve 108 is then warmed in third heat exchanger 112 and then warmed again in the first heat exchanger 14 before exiting system 210 as nitrogen vent stream 318. Unlike system 10 (where stream 110 passes through third heat exchanger 112, then second heat exchanger 88, then first heat exchanger 14), stream 310 in system 210 only passes through third heat exchanger 112 and first heat exchanger 14. Nitrogen vent stream 318 preferably comprises less than 2% methane and more than 98% nitrogen.

A liquid bottoms stream 320 from second column 104 is warmed in second heat exchanger 288, exiting as stream 330, which feeds into second separator 132. Stream 330 preferably feeds into second separator 132 at a temperature −250 to −275° F. and a pressure between 50-115 psia. A vapor stream 334 exits the separator 132 and is then routed to the second column 104. Likewise, a liquid stream 366, preferably comprising less than 6% nitrogen and more preferably less than 4% nitrogen, exits the separator 132. The permissible nitrogen specification for the second tower is preferably more lenient than the first tower because of the relative flow rates from the bottom of each tower and in order to allow heat exchanger 288 to operate more efficiently. Second column 104 preferably does not comprise an independent reboiler, but uses a heat exchange pass in the second heat exchanger as a source of heat. The vapor generated in this (reboiler) heat exchange pass is separated in the second separator 132 providing stream 334 that is returned to a bottom of column 104 as an ascending vapor stream. Bottoms stream 366 from second separator 132 is then routed to level valve 168 as required to hold a desired liquid level in the separator 132. Stream 366 exits the level valve 168 as stream 370 where it then enters second heat exchanger 288. Stream 370 is warmed in second heat exchanger 288, exiting as stream 372, which is mixed in mixer 74 with a third portion 271 of the bottoms stream from first column 32 to form low pressure sales gas stream 378.

System 210 utilizes efficient heat exchange between various process streams to improve process performance. In first heat exchanger 14, feed stream 12 and a portion 24 of an overhead stream from first separator 18 are cooled through heat exchange with first portion 56 of the first column bottoms stream, second portion 64 of the first column bottoms stream, mixed stream 276, overhead stream 316 from the second column 104 (downstream of heat exchange in third heat exchanger 112) and a bottoms stream 162 from the first separator 18. The feed stream 12 is cooled in first heat exchanger 14 upstream of feeding first separator 18. The purpose of separator 18 is to provide separation of heavier hydrocarbon components such as propane, butanes and gasolines from the inlet feed stream 12 before entering the colder part of the system 210. Portion 24 is cooled in first heat exchanger 14 upstream of routing the stream to the first column 32. In second heat exchanger 288, a first portion of overhead stream 86 from first column 32 is cooled through heat exchange with bottoms stream 320 from second column 104 and bottoms stream 370 from second separator 132. In third heat exchanger 112, a second portion of overhead stream 86 is subcooled through heat exchange with overhead stream 310 from second column 104. System 210 also preferably allows for heat exchange between a second portion 34 of the overhead stream from the first separator 18 and a liquid stream 46 from a bottom of column 32 in heat exchanger 36. The exchanger 36 (tube) is the tube side of a shell and tube style heat exchanger used to provide the necessary heat source for the bottom of the first column 32. The exchanger depicted as 36 (shell) is the shell side of the exchanger 36.

System 210 preferably also comprises a fourth heat exchanger comprising a tube side 82 (tube) and a shell side 82 (shell), that are independent pieces of equipment configured as a vertical tube, falling film condenser. Heat exchanger 82 (tube) and 82 (shell) provide the similar function as an internal knockback condenser 482 and shown and described in connection with FIG. 3 and in U.S. Patent Application Publication 2007/0180855, incorporated herein by reference. A vapor stream 80 from a top of first column 32 passes through a tube side 82 (tube) of a heat exchanger 82 (tube), where it is partially condensed, with a vapor portion exiting as first fractionating column overhead stream 86 and a liquid portion 84 returning to column 32. The refrigerant source for heat exchanger 82 in system 210 is a third portion of the bottom fluid from the first column 32 (stream 269), which is routed to the shell side of the exchanger 82, and the condensed liquid from first column overhead stream is designed to operate on the tube side of exchanger 82. Unlike system 10, in system 210 column 104 can be located in any position and is not limited to an elevated position related to column 32. Heat exchanger 82 is preferably mounted above (in an elevated position relative to) column 32, similar to knockback condenser 482 in FIG. 3. Since the column 104 in system 210 can be installed independently of heat exchanger 82 and column 32, there is greater flexibility with respect to the footprint required for installation of system 210 compared to system 10 and as to the overall height required for facility installation in system 210 compared to system 10. In addition, the cost of system 210 is lower than system 10 due to more conventional foundation requirements for installation.

Acceptable inlet compositions in which systems 10 and 210 may operate satisfactorily are listed in the following Table 1:

TABLE 1

INLET STREAM COMPOSITIONS

| Inlet Component | Acceptable Inlet Composition Ranges |
|---|---|
| Methane | 50-95% |
| Ethane and Heavier Components | 0-20% |
| Carbon Dioxide | 0-100 ppm |
| Nitrogen | 5-50% Preferably 20% or greater for system 10 and less than 20% for system 210 |

Example 1—Computer Simulation for 100 MMSCFD Feed with 20% Nitrogen in System 10

Still referring to FIG. 1, a system 10 and method for processing a 100 MMSCFD NRU feed stream 12, comprising approximately 20 mol % nitrogen and 72 mol % methane at 120° F. and 664.5 psia based on a computer simulation is shown and described below. The nitrogen content of feed stream 12 is at the low end of the preferred nitrogen range of 20% or more for system 10, but system 10 would be expected to perform even better with higher nitrogen levels in feed stream 12. This amount of nitrogen in feed stream 12 is also used for comparison to system 210 in Example 2 below, which also has 20% nitrogen (the high end of preferred nitrogen levels for system 210).

Feed stream 12 passes through first heat exchanger 14, which preferably comprises a plate-fin heat exchanger. The feed stream emerges from the heat exchanger and enters separator 18 having been cooled to −17.4° F. as stream 16. This cooling is the result of heat exchange with other process streams 56, 64, 76, 116, and 162. The cooled stream 16 is then separated into an overhead vapor stream 20 and a bottoms liquid stream 158. Bottoms liquid stream 158 comprises around 1.8% nitrogen, 26% methane, 10% ethane, and 14% propane. The pressure of stream 158 is reduced in valve 160 to around 165 psia in mixed liquid-vapor stream 162. Stream 162 is then warmed in heat exchanger 14, exiting as stream 164 at 101.7° F. and 160 psia. Stream 164 may be sent to an NGL stabilizer column (not shown) for further processing.

Overhead vapor stream 20, comprising around 20% nitrogen and around 73% methane is split in splitter 22 into streams 24 and 34. Stream 24 is then routed for another pass through heat exchanger 14, exiting as a subcooled liquid stream 26 having been cooled to −195° F. Stream 26 passes through a pressure reducing valve 28, exiting as stream 30 with a pressure around 395 psia. Stream 30 feeds into an upper tray level on first fractionating column 32. First fractionating column 32 is preferably a high pressure column upstream of a low pressure second fractionating column 104. Vapor stream 34, the other portion of the first separator overhead stream, passes through the tube side of exchanger 36 in order to provide heat for the reboiler 36 for first fractionating column 32, exiting as mixed liquid-vapor stream 38 having been cooled to around −138° F. Around 8.04 million Btu/Hr of heat energy (Q-4) passes from tube side of reboiler 36 (tube) (from stream 34) to shell side of reboiler 36 (shell) (to stream 46). Stream 38 passes through temperature control valve 40 (preferably a throttling valve), exiting as stream 42 with a reduced pressure of around 391 psia. Mixed liquid-vapor stream 42 feeds into first fractionating column 32 near a mid-level tray location. Stream 80 comprising around 59% nitrogen and 40.5% methane at −189° F. from the top of column 32 feeds into a tube side 82 (tube) of a shell and tube heat exchanger that acts as a condenser for column 32. Alternatively, column 32 may be configured with a knockback condenser 482 as further described with respect to FIG. 3. A liquid portion of stream 80 returns to column 32 as stream 84 and a vapor portion exits tube side 82 (tube) as overhead stream 86 comprising around 66% nitrogen and 34% methane at −199° F. and 385 psia. Around 1.86 million Btu/hr of heat energy (Q-1) passes from tube side 82 (tube) to shell side 82 (shell).

First column overhead stream 86 passes through second heat exchanger 88, which preferably comprises a plate-fin heat exchanger, exiting as cooled, mixed liquid-vapor stream 90 at −224° F. Stream 90 then enters a third separator or flash drum 92 where it is separated into liquid stream 98 and vapor stream 144. Stream 98 comprises 63% nitrogen and 37% methane at −224° F. and 379 psia. Stream 98 passes through valve 100, existing as stream 102 at −276° F. with a pressure of around 70 psia. Stream 102 feeds into a mid-level of second fractionating column 104. Vapor stream 144 passes through third heat exchanger 112, which preferably comprises a plate-fin heat exchanger, exiting as stream 146 having been subcooled to around −296° F. Stream 146 then passes through valve 148 to reduce the pressure of exiting stream 150 to around 70 psia. Stream 150 comprising around 86% nitrogen and 14% methane at −295° F. and 70 psia then feeds into an upper level of column 104. A third stream, stream 134 comprising around 20% nitrogen and 80% methane at −226° F. and 65 psia, also feeds into a lower level of column 104 as an ascending vapor stream.

Components of feed streams 150, 102, and 134 are separated in second fractionating column 104 into an overhead stream 106 and a bottoms stream 120. Overhead stream 106 comprises around 98% nitrogen and less than 2% methane at −290° F. and 62.5 psia before passing through valve 108, existing at stream 110 at −300° F. and 20 psia. Stream 110 passes through third heat exchanger 112, exiting as stream 114 warmed to −229° F. Stream 114 then passes through second heat exchanger 88, exiting as stream 116 warmed to −204° F. Stream 116 then passes through first heat exchanger 14, exiting as stream 118 warmed to 101.7° F. Stream 118 is the nitrogen vent stream for system 10.

Bottoms stream 120 comprising around 9% nitrogen and 91% methane at −246° F. and 65 psia is split in splitter 122 into streams 124 and 180. Liquid stream 124 passes through the shell side 82 (shell) of a shell and tube heat exchanger that acts as a condenser for column 32, exiting as vapor stream 126 at around −221° F. Stream 180 passes through valve 182, exiting as stream 184. Streams 184 and 126 are mixed in mixer 128 to form stream 130 that feeds into a low pressure second separator 132. Valve 182 is used to control the temperature of mixed stream 130 feeding into separator 132, by controlling a flow rate of stream 180 inversely relative to stream 124. Stream 156 is also preferably mixed in mixer 128 to form stream 130, but may also be separately fed into separator 132. Stream 130 (and 156 if separate from 130) are separated in separator 132 into overhead vapor stream 134 and bottoms liquid stream 166. Stream 134 is returned to second fractionating column 104 as an ascending vapor stream providing heat to the second column as is similar to having a reboiler in second column 104. Bottoms stream 166 comprises less than 2% nitrogen and around 96% methane at −226° F. and 65 psia. Stream 166 passes through level valve 168, exiting as stream 170 with a slight pressure reduction to 60 psia. Stream 170 passes through heat exchanger 88, exiting as stream 172 having been warmed to −204° F. Stream 172 is mixed with a partially vaporized third portion 72 of a bottoms stream from fractionating column 32 in mixer 74 to form mixed stream 76.

Liquid stream 46 from a bottom of column 32 passes through reboiler 36 (shell) where there is heat exchange with stream 34 (which is a portion of first separator overhead stream for system 10). A vapor portion 44 of stream 46 returns to the bottom of column 32 and a liquid portion exits as bottoms stream 48 comprising less than 2% nitrogen and around 89% methane at −145° F. and 388.5 psia. Bottoms stream 48 is then split in splitter 50 into streams 52, 60, 68 and 152. Stream 52 passes through valve 54, exiting as stream 56 at 345 psia. Stream 56 then passes through heat exchanger 14, exiting as stream 58 having been warmed to around 101.5° F. and at a pressure of 340 psia. Stream 58 is one of the three sales gas streams. Stream 60 passes through valve 62, exiting as stream 64 at −183° F. and a pressure of 165 psia. Stream 64 then passes through heat exchanger 14, exiting as stream 66 having been warmed to around 101.7° F. and a pressure of 160 psia. Stream 66 is a second of the sales gas streams. Stream 68 passes through valve 70, exiting as stream 72 having been cooled to −216° F. at a pressure of 65 psia. Stream 72 is mixed with stream 172 in mixer 74 to form stream 76 at −217.8° F. and 57.5 psia, which passes through heat exchanger 14 exiting as stream 78 at 101.7° F. and 55 psia. Stream 78 is a third sales gas stream. Of the sales gas streams, stream 58 is a high pressure stream (higher than streams 66 and 78) and depending on the requirements of the installation, this stream may not need further compression to enter existing facility equipment or the compression requirements would be significantly reduced when compared with existing nitrogen rejection technologies. Stream 66 is an intermediate pressure stream (lower pressure than stream 58 but higher pressure than stream 78), and stream 78 is a low pressure stream (lower pressure than streams 58 and 66). These streams 66 and 78 may be further compressed as needed to meet pipeline requirements.

Stream 152, the fourth portion split from bottoms stream 48, passes through valve 154, exiting as partially vaporized stream 156 having been cooled to −214° F. at a pressure of 70 psia. Stream 156 is the third stream to enter mixer 128. The mixed stream from 128 exits as stream 130 and feeds into second separator 132.

The specific flow rates, temperatures, pressures, and compositions of various flow streams referred to in connection with the above discussion of a computer simulation for a system 10 appear in Table 2 below. These values are based on a feed gas stream 12 comprising 20% nitrogen, around 73% methane, and 50 ppm of carbon dioxide with a flow rate of 100 MMSCFD.

TABLE 2

FLOW STREAM PROPERTIES FOR EXAMPLE 1 - SYSTEM 10

| Mole Fraction/ Property - Stream No. | 12 | 16 | 20 | 24 | 26 | 30 | 34 |
|---|---|---|---|---|---|---|---|
| Nitrogen | 20.0000* | 20.0000 | 20.1842 | 20.1842 | 20.1842 | 20.1842 | 20.1842 |
| CO2 | 0.005* | 0.005 | 0.00499903 | 0.00499903 | 0.00499903 | 0.00499903 | 0.00499903 |
| Methane | 72.7672* | 72.7672 | 73.2420 | 73.2420 | 73.2420 | 73.2420 | 73.2420 |
| Ethane | 4.28875* | 4.28875 | 4.22698 | 4.22698 | 4.22698 | 4.22698 | 4.22698 |
| Propane | 1.64580* | 1.64580 | 1.51655 | 1.51655 | 1.51655 | 1.51655 | 1.51655 |
| i-Butane | 0.313443* | 0.313443 | 0.251551 | 0.251551 | 0.251551 | 0.251551 | 0.251551 |
| n-Butane | 0.616397* | 0.616397 | 0.445057 | 0.445057 | 0.445057 | 0.445057 | 0.445057 |
| i-Pentane | 0.126174* | 0.126174 | 0.0640669 | 0.0640669 | 0.0640669 | 0.0640669 | 0.0640669 |
| n-Pentane | 0.103348* | 0.103348 | 0.0447387 | 0.0447387 | 0.0447387 | 0.0447387 | 0.0447387 |
| Hexane | 0.133944* | 0.133944 | 0.0198272 | 0.0198272 | 0.0198272 | 0.0198272 | 0.0198272 |
| Temperature ° F. | 120* | −17.4194 | −17.4875 | −17.4875 | −195* | −195.030 | −17.4875 |
| Pressure psia | 664.5* | 659.5 | 658.5 | 658.5 | 653.5 | 395* | 658.5 |
| Mole Fraction Vapor % | 100 | 99* | 100 | 100 | 0 | 0 | 100 |
| Std Vapor Volumetric Flow MMSCFD | 100* | 100 | 98.9982 | 70.5388 | 70.5388 | 70.5388 | 28.4594 |

| Mole Fraction/ Property - Stream No. | 38 | 42 | 44 | 46 | 48 | 52 | 56 |
|---|---|---|---|---|---|---|---|
| Nitrogen | 20.1842 | 20.1842 | 7.76152 | 3.73593 | 1.93913 | 1.93913 | 1.93913 |
| CO2 | 0.00499903 | 0.00499903 | 0.00166185 | 0.00531146 | 0.00694044 | 0.00694044 | 0.00694044 |
| Methane | 73.2420 | 73.2420 | 91.6747 | 89.7532 | 88.8955 | 88.8955 | 88.8955 |
| Ethane | 4.22698 | 4.22698 | 0.527887 | 4.23647 | 5.89178 | 5.89178 | 5.89178 |
| Propane | 1.51655 | 1.51655 | 0.0315056 | 1.47234 | 2.11545 | 2.11545 | 2.11545 |
| i-Butane | 0.251551 | 0.251551 | 0.00111929 | 0.242955 | 0.350896 | 0.350896 | 0.350896 |
| n-Butane | 0.445057 | 0.445057 | 0.00154193 | 0.429712 | 0.620823 | 0.620823 | 0.620823 |
| i-Pentane | 0.0640669 | 0.0640669 | 2.12102E−05 | 0.0617961 | 0.0893689 | 0.0893689 | 0.0893689 |
| n-Pentane | 0.0447387 | 0.0447387 | 2.53333E−05 | 0.0431562 | 0.0624074 | 0.0624074 | 0.0624074 |
| Hexane | 0.0198272 | 0.0198272 | 1 62426E−06 | 0.0191229 | 0.0276576 | 0.0276576 | 0.0276576 |
| Temperature ° F. | −137.715* | −160.830 | −145.335 | −151.495 | −145.335 | −145.335 | −151.019 |
| Pressure psia | 653.5 | 391.273* | 388.5 | 388.5 | 388.5 | 388.5 | 345* |
| Mole Fraction Vapor % | 40.1571 | 50.8018 | 100 | 0 | 0 | 0 | 4.97369 |
| Std Vapor Volumetric Flow MMSCFD | 28.4594 | 28.4594 | 31.6770 | 102.647 | 70.9699 | 42.2528 | 42.2528 |

| Mole Fraction/ Property - Stream No. | 58 | 60 | 64 | 66 | 68 | 72 | 76 |
|---|---|---|---|---|---|---|---|
| Nitrogen | 1.93913 | 1.93913 | 1.93913 | 1.93913 | 1.93913 | 1.93913 | 1.91623 |
| CO2 | 0.00694044 | 0.00694044 | 0.00694044 | 0.00694044 | 0.00694044 | 0.00694044 | 0.00390743 |
| Methane | 88.8955 | 88.8955 | 88.8955 | 88.8955 | 88.8955 | 88.8955 | 93.0578 |
| Ethane | 5.89178 | 5.89178 | 5.89178 | 5.89178 | 5.89178 | 5.89178 | 3.23637 |
| Propane | 2.11545 | 2.11545 | 2.11545 | 2.11545 | 2.11545 | 2.11545 | 1.15643 |
| i-Butane | 0.350896 | 0.350896 | 0.350896 | 0.350896 | 0.350896 | 0.350896 | 0.191808 |
| n-Butane | 0.620823 | 0.620823 | 0.620823 | 0.620823 | 0.620823 | 0.620823 | 0.339356 |
| i-Pentane | 0.0893689 | 0.0893689 | 0.0893689 | 0.0893689 | 0.0893689 | 0.0893689 | 0.0488510 |
| n-Pentane | 0.0624074 | 0.0624074 | 0.0624074 | 0.0624074 | 0.0624074 | 0.0624074 | 0.0341132 |
| Hexane | 0.0276576 | 0.0276576 | 0.0276576 | 0.0276576 | 0.0276576 | 0.0276576 | 0.0151182 |
| Temperature ° F. | 101.540 | −145.335 | −183.260 | 101.727* | −145.335 | −216.425 | −217.785 |
| Pressure psia | 340 | 388.5 | 165* | 160 | 388.5 | 65* | 57.5 |
| Mole Fraction Vapor % | 100 | 0 | 23.9490 | 100 | 0 | 36.8655 | 75.7586 |
| | 42.2528 | 17.5* | 17.5 | 17.5 | 8* | 8 | 20.5208 |

TABLE 2-continued

FLOW STREAM PROPERTIES FOR EXAMPLE 1 - SYSTEM 10

| Mole Fraction/ Property - Stream No. | 78 | 80 | 84 | 86 | 90 | 98 |
|---|---|---|---|---|---|---|
| Nitrogen | 1.91623 | 59.4154 | 31.3690 | 66.3824 | 66.3824 | 63.1382 |
| CO2 | 0.00390743 | 0.000326395 | 0.00130540 | 8.31993E−05 | 8.31993E−05 | 9.63111E−05 |
| Methane | 93.0578 | 40.4844 | 68.1744 | 33.6059 | 33.6059 | 36.8482 |
| Ethane | 3.23637 | 0.0959951 | 0.435886 | 0.0115625 | 0.0115625 | 0.0134116 |
| Propane | 1.15643 | 0.00367169 | 0.0182156 | 5.88178E−05 | 5.88178E−05 | 6.84284E−05 |
| i-Butane | 0.191808 | 9.24393E−05 | 0.000463516 | 2.59683E−07 | 2.59683E−07 | 3.02222E−07 |
| n-Butane | 0.339356 | 0.000126703 | 0.000635588 | 2.90617E−07 | 2.90617E−07 | 3.38227E−07 |
| i-Pentane | 0.0488510 | 8.01838E−07 | 4.02941 E−06 | 7.25370E−11 | 7.25370E−11 | 8.44288E−11 |
| n-Pentane | 0.0341132 | 1.29730E−06 | 6.51837E−06 | 3.23020E−10 | 3.23020E−10 | 3.75973E−10 |
| Hexane | 0.0151182 | 8.00757E−08 | 4.02408E−07 | 4.85066E−12 | 4.85066E−12 | 5.64582E−12 |
| Temperature ° F. | 101.727* | −189.094 | −199.103 | −199.103 | −223.793 | −223.896 |
| Pressure psia | 55 | 385 | 385 | 385 | 380 | 379 |
| Mole Fraction Vapor % | 100 | 100 | 0 | 100 | 15* | 1.22019 |
| Std Vapor Volumetric Flow MMSCFD | 20.5208 | 34.9908 | 6.96253 | 28.0282 | 28.0282 | 24.0804 |

| Mole Fraction/ Property - Stream No. | 102 | 106 | 110 | 114 | 116 | 118 | 120 |
|---|---|---|---|---|---|---|---|
| Nitrogen | 63.1382 | 98.4286 | 98.4286 | 98.4286 | 98.4286 | 98.4286 | 8.92683 |
| CO2 | 9.63111E−05 | 4.30858E−10 | 4.30858E−10 | 4.30858E−10 | 4.30858E−10 | 4.30858E−10 | 0.000178860 |
| Methane | 36.8482 | 1.57143 | 1.57143 | 1.57143 | 1.57143 | 1.57143 | 91.0478 |
| Ethane | 0.0134116 | 4.62270E−08 | 4.62270E−08 | 4.62270E−08 | 4.62270E−08 | 4.62270E−08 | 0.0250017 |
| Propane | 6.84284E−05 | 5.06148E−13 | 5.06148E−13 | 5.06148E−13 | 5.06148E−13 | 5.06148E−13 | 0.000145857 |
| i-Butane | 3.02222E−07 | 0 | 0 | 0 | 0 | 0 | 7.50615E−07 |
| n-Butane | 3.38227E−07 | 0 | 0 | 0 | 0 | 0 | 8.64756E−07 |
| i-Pentane | 8.44288E−11 | 0 | 0 | 0 | 0 | 0 | 4.25543E−10 |
| n-Pentane | 3.75973E−10 | 0 | 0 | 0 | 0 | 0 | 1.57601E−09 |
| Hexane | 5.64582E−12 | 0 | 0 | 0 | 0 | 0 | 1.78131E−11 |
| Temperature ° F. | −275.993 | −290.157 | −299.700 | −228.767 | −204.101* | 101.727* | −245.576 |
| Pressure psia | 70* | 62.5 | 20* | 19 | 18 | 17 | 65 |
| Std Vapor Volumetric Flow MMSCFD | 41.7445 | 100 | 100 | 100 | 100 | 100 | 0 |
| | 24.0804 | 18.7245 | 18.7245 | 18.7245 | 18.7245 | 18.7245 | 15.2885 |

| Mole Fraction/ Property - Stream No. | 124 | 126 | 130 | 134 | 144 |
|---|---|---|---|---|---|
| Nitrogen | 8.92683 | 8.92683 | 7.71205 | 19.8681 | 86.1708 |
| CO2 | 0.000178860 | 0.000178860 | 0.00135433 | 6.72785E−05 | 3.22226E−06 |
| Methane | 91.0478 | 91.0478 | 90.6737 | 80.1220 | 13.8289 |
| Ethane | 0.0250017 | 0.0250017 | 1.04492 | 0.00971970 | 0.000283701 |
| Propane | 0.000145857 | 0.000145857 | 0.367883 | 9.71550E−05 | 1.96930E−07 |
| i-Butane | 7.50615E−07 | 7.50615E−07 | 0.0610024 | 7.01445E−07 | 2.08579E−10 |
| n-Butane | 8.64756E−07 | 8.64756E−07 | 0.107928 | 8.48176E−07 | 2.15697E−10 |
| i-Pentane | 4.25543E−10 | 4.25543E−10 | 0.0155364 | 7.47518E−10 | 1.60550E−15 |
| n-Pentane | 1.57601E−09 | 1.57601E−09 | 0.0108493 | 2.51369E−09 | 2.50524E−14 |
| Hexane | 1.78131E−11 | 1.78131E−11 | 0.00480815 | 2.27921 E−11 | 5.04462E−16 |
| Temperature ° F. | −245.576 | −221.201 | −225.657 | −225.657 | −223.896 |
| Pressure psia | 65 | 65 | 65 | 65 | 379 |
| Std Vapor Volumetric Flow MMSCFD | 0 | 100* | 32.3405 | 100 | 100 |
| | 5.12485 | 5.12485 | 18.5056 | 5.98481 | 3.94784* |

TABLE 2-continued

FLOW STREAM PROPERTIES FOR EXAMPLE 1 - SYSTEM 10

| Mole Fraction/ Property - Stream No. | 146 | 150 | 152 | 156 | 158 | 162 | 164 |
|---|---|---|---|---|---|---|---|
| Nitrogen | 86.1708 | 86.1708 | 1.93913 | 1.93913 | 1.79515 | 1.79515 | 1.79515 |
| CO2 | 3.22226E−06 | 3.22226E−06 | 0.00694044 | 0.00694044 | 0.00509588 | 0.00509588 | 0.00509588 |
| Methane | 13.8289 | 13.8289 | 88.8955 | 88.8955 | 25.8431 | 25.8431 | 25.8431 |
| Ethane | 0.000283701 | 0.000283701 | 5.89178 | 5.89178 | 10.3922 | 10.3922 | 10.3922 |
| Propane | 1.96930E−07 | 1.96930E−07 | 2.11545 | 2.11545 | 14.4181 | 14.4181 | 14.4181 |
| i-Butane | 2.08579E−10 | 2.08579E−10 | 0.350896 | 0.350896 | 6.42948 | 6.42948 | 6.42948 |
| n-Butane | 2.15697E−10 | 2.15697E−10 | 0.620823 | 0.620823 | 17.5478 | 17.5478 | 17.5478 |
| i-Pentane | 1.60550E−15 | 1.60550E−15 | 0.0893689 | 0.0893689 | 6.26342 | 6.26342 | 6.26342 |
| n-Pentane | 2.50524E−14 | 2.50524E−14 | 0.0624074 | 0.0624074 | 5.89497 | 5.89497 | 5.89497 |
| Hexane | 5.04462E−16 | 5.04462E−16 | 0.0276576 | 0.0276576 | 11.4107 | 11.4107 | 11.4107 |
| Temperature ° F. | −295.724* | −294.945 | −145.335 | −214.065 | −17.4875 | −38.8154 | 101.727* |
| Pressure psia | 374 | 70* | 388.5 | 70* | 658.5 | 165* | 160 |
| Mole Fraction Vapor % | 0 | 0 | 0 | 36.0482 | 0 | 23.0297 | 53.0054 |
| Std Vapor Volumetric Flow MMSCFD | 3.94784 | 3.94784 | 3.21712 | 3.21712 | 1.00183 | 1.00183 | 1.00183 |

| Mole Fraction/ Property - Stream No. | 166 | 170 | 172 | 180 | 184 |
|---|---|---|---|---|---|
| Nitrogen | 1.90160 | 1.90160 | 1.90160 | 8.92683 | 8.92683 |
| CO2 | 0.00196953 | 0.00196953 | 0.00196953 | 0.000178860 | 0.000178860 |
| Methane | 95.7172 | 95.7172 | 95.7172 | 91.0478 | 91.0478 |
| Ethane | 1.53973 | 1.53973 | 1.53973 | 0.0250017 | 0.0250017 |
| Propane | 0.543680 | 0.543680 | 0.543680 | 0.000145857 | 0.000145857 |
| i-Butane | 0.0901606 | 0.0901606 | 0.0901606 | 7.50615E−07 | 7.50615E−07 |
| n-Butane | 0.159516 | 0.159516 | 0.159516 | 8.64756E−07 | 8.64756E−07 |
| i-Pentane | 0.0229626 | 0.0229626 | 0.0229626 | 4.25543E−10 | 4.25543E−10 |
| n-Pentane | 0.0160351 | 0.0160351 | 0.0160351 | 1.57601E−09 | 1.57601 E−09 |
| Hexane | 0.00710639 | 0.00710639 | 0.00710639 | 1.78131E−11 | 1.78131 E−11 |
| Temperature ° F. | −225.657 | −227.698 | −204.007 | −245.576 | −245.576 |
| Pressure psia | 65 | 60* | 57.5 | 65 | 65 |
| Mole Fraction Vapor % | 0 | 0.990159 | 96.2238 | 0 | 0 |
| Std Vapor Volumetric Flow MMSCFD | 12.5208 | 12.5208 | 12.5208 | 10.1636 | 10.1636 |

It will be appreciated by those of ordinary skill in the art that these values are based on the particular parameters and composition of the feed stream in the above computer simulation example. The temperature, pressure, and compositional values will differ depending on the parameters and composition of the NRU Feed stream 12 and specific operating parameters for various pieces of equipment in system 10.

Example 2—Computer Simulation for 100 MMSCFD Feed with 20% Nitrogen in System 210

Referring to FIG. 2, a system 210 and method for processing a 100 MMSCFD NRU feed stream 12, comprising approximately 20 mol % nitrogen and 72 mol % methane at 120° F. and 614.5 psia based on a computer simulation is shown and described below. Feed stream 12 passes through first heat exchanger 14, which preferably comprises a plate-fin heat exchanger. The feed stream emerges from the heat exchanger and enters separator 18 having been cooled to −74.68° F. as stream 16 (this amount of cooling is greater than in system 10). This cooling is the result of heat exchange with other process streams 56, 64, 276, 316, and 162. The cooled stream 16 is then separated in first separator 18 into an overhead vapor stream 20 and a bottoms liquid stream 158. Bottoms liquid stream 158 comprises around 2.41% nitrogen, 38.6% methane, 17.6% ethane, and 18.5% propane. The pressure of stream 158 is reduced in valve 160 to around 165 psia in mixed liquid-vapor stream 162. Stream 162 is then warmed in heat exchanger 14, exiting as stream 164 at 102.7° F. and 160 psia. Stream 164 may be sent to an NGL stabilizer column (not shown) for further processing.

Overhead vapor stream 20, comprising around 20.9% nitrogen and around 74.6% methane is split in splitter 22 into streams 24 and 34. Stream 24 is then routed for another pass through heat exchanger 14, exiting as a subcooled liquid stream 26 having been cooled to −195° F. Stream 26 passes through a pressure reducing valve 28, exiting as stream 30 with a pressure around 425 psia. Stream 30 feeds into an upper tray level on first fractionating column 32.

First fractionating column 32 is preferably a high pressure column upstream of a low pressure second fractionating column 104. Vapor stream 34, the other portion of the first separator overhead stream, passes through the tube side of exchanger 36 in order to provide heat for the reboiler 36 for first fractionating column 32, exiting as mixed liquid-vapor stream 38 having been cooled to around −137.4° F. Around 7.15 million Btu/Hr of heat energy (Q-4) passes from tube side of reboiler 36 (tube) (from stream 34) to shell side of reboiler 36 (shell) (to stream 46). Stream 38 passes through temperature control valve 40 (preferably a throttling valve), exiting as stream 42 with a reduced pressure of around 421.3 psia. Mixed liquid-vapor stream 42 feeds into first fractionating column 32 near a mid-level tray location. Stream 80 comprising around 61.6% nitrogen and 38.3% methane at −190° F. from the top of column 32 feeds into a tube side 82 (tube) of a shell and tube heat exchanger that acts as a condenser for column 32. A liquid portion of stream 80 returns to column 32 as stream 84 and a vapor portion exits tube side 82 (tube) as overhead stream 86 comprising around 77.5% nitrogen and 22.5% methane at −209.85° F. and 415 psia. The amount of nitrogen in overhead stream 86 in system 210 is higher than the similar computer simulation example for system 10 (66% nitrogen) and the amount of methane is lower than the example for system 10 (34% methane), showing greater efficiency in nitrogen removal in system 210. Around 6.07 million Btu/hr of heat energy (Q-1) passes from tube side 82 (tube) to shell side 82 (shell).

First column overhead stream 86 is split in splitter 287 into a first portion stream 289 and a second portion stream 344. Vapor stream 289 passes through second heat exchanger 288, which preferably comprises a plate-fin heat exchanger, exiting as cooled, mixed liquid-vapor stream 298 at −265° F. Stream 298 at −265° F. and 412.5 psia passes through valve 100, existing as stream 302 at −285° F. with a pressure of around 70 psia. Mixed liquid-vapor stream 302 feeds into a mid-level of second fractionating column 104. Vapor stream 344 passes through third heat exchanger 112, which preferably comprises a plate-fin heat exchanger, exiting as stream 346 having been subcooled to around −294° F. Stream 346 then passes through valve 148 to reduce the pressure of exiting stream 350 to around 75 psia. Stream 350 then feeds into an upper level of column 104. A third stream, stream 334 comprising around 42% nitrogen and 58% methane at −236° F. and 64 psia, also feeds into a lower level of column 104 as an ascending vapor stream.

Components of feed streams 350, 302, and 334 are separated in second fractionating column 104 into an overhead stream 306 and a bottoms stream 320. Overhead stream 306 comprises around 97.8% nitrogen and around 2.2% methane at −285° F. and 72.5 psia before passing through valve 108, existing at stream 310 at −297° F. and 20 psia. Stream 310 passes through third heat exchanger 112, exiting as stream 316 warmed to −215° F. Stream 316 then passes through first heat exchanger 14, exiting as stream 318 warmed to around 103° F. Stream 318 is the nitrogen vent stream for system 210.

Bottoms stream 320 comprising around 32% nitrogen and 68% methane at −269° F. and 75 psia is warmed in second heat exchanger 288, exiting as mixed liquid-vapor stream 330 at −236° F. Stream 330 is separated in separator 132 into overhead vapor stream 334 and bottoms liquid stream 366. Stream 334 is returned to second fractionating column 104 as an ascending vapor stream providing heat to the second column as is similar to having a reboiler in second column 104. Bottoms stream 366 comprises around 5% nitrogen and around 95% methane at −236° F. and 64 psia. Stream 366 passes through heat exchanger 288, exiting as mixed liquid-vapor stream 372 having been warmed to −217.5° F. Stream 372 is mixed with a partially vaporized third portion 271 of a bottoms stream from fractionating column 32 (downstream of heat exchange in fourth heat exchanger 82) in mixer 74 to form mixed stream 276.

Liquid stream 46 from a bottom of column 32 passes through reboiler 36 (shell) where there is heat exchange with stream 34 (which is a portion of first separator overhead stream for system 210). A vapor portion 44 of stream 46 returns to the bottom of column 32 and a liquid portion exits as bottoms stream 48 comprising around 2.9% nitrogen and around 91.2% methane at −145° F. and 418.5 psia. Bottoms stream 48 is then split in splitter 50 into streams 52 (first portion), 60 (second portion), and (third portion) Unlike system 10, there is no fourth portion of the first column bottoms stream in system 210. Stream 52 passes through valve 54, exiting as stream 56 at 345 psia. Stream 56 then passes through heat exchanger 14, exiting as stream 58 having been warmed to around 103° F. and at a pressure of 340 psia. Stream 58 is one of the three sales gas streams. Stream 60 passes through valve 62, exiting as stream 64 at −185° F. and a pressure of 165 psia. Stream 64 then passes through heat exchanger 14, exiting as stream 66 having been warmed to around 103° F. and a pressure of 160 psia. Stream 66 is a second of the sales gas streams. Stream 68 passes through valve 70, exiting as stream 269 having been cooled to −214° F. at a pressure of 75 psia. Stream 269 is a refrigerant for heat exchanger 82, exiting as stream 271 warmed to −194.7° F. Stream 271 is mixed with stream 372 in mixer 74 to form stream 276 at −206° F. and 72.5 psia, which passes through heat exchanger 14 exiting as stream 378 at 102.7° F. and 70 psia. Stream 378 is a third sales gas stream. Of the sales gas streams, stream 58 is a high pressure stream (higher than streams 66 and 378) and depending on the requirements of the installation, this stream may not need further compression to enter existing facility equipment or the compression requirements would be significantly reduced when compared with existing nitrogen rejection technologies. Stream 66 is an intermediate pressure stream (lower pressure than stream 58 but higher pressure than stream 378), and stream 378 is a low pressure stream (lower pressure than streams 58 and 66). These streams 66 and 378 may be further compressed as needed to meet pipeline requirements.

The specific flow rates, temperatures, pressures, and compositions of various flow streams referred to in connection with the above discussion of a computer simulation for a system 210 appear in Table 3 below. These values are based on a feed gas stream 12 comprising 20% nitrogen, around 73% methane, and 50 ppm of carbon dioxide with a flow rate of 100 MMSCFD.

TABLE 3

FLOW STREAM PROPERTIES FOR EXAMPLE 2 - SYSTEM 210

| Mole Fraction/ Property - Stream No. | 12 | 16 | 20 | 24 | 26 | 30 | 34 |
|---|---|---|---|---|---|---|---|
| Nitrogen | 20.0000* | 20.0000 | 20.9263 | 20.9263 | 20.9263 | 20.9263 | 20.9263 |
| CO2 | 0.005* | 0.005 | 0.00479276 | 0.00479276 | 0.00479276 | 0.00479276 | 0.00479276 |
| Methane | 72.7672* | 72.7672 | 74.5651 | 74.5651 | 74.5651 | 74.5651 | 74.5651 |
| Ethane | 4.28875* | 4.28875 | 3.58786 | 3.58786 | 3.58786 | 3.58786 | 3.58786 |
| Propane | 1.64580* | 1.64580 | 0.756602 | 0.756602 | 0.756602 | 0.756602 | 0.756602 |
| i-Butane | 0.313443* | 0.313443 | 0.0621838 | 0.0621838 | 0.0621838 | 0.0621838 | 0.0621838 |
| n-Butane | 0.616397* | 0.616397 | 0.0867579 | 0.0867579 | 0.0867579 | 0.0867579 | 0.0867579 |
| i-Pentane | 0.126174* | 0.126174 | 0.00579575 | 0.00579575 | 0.00579575 | 0.00579575 | 0.00579575 |
| n-Pentane | 0.103348* | 0.103348 | 0.00376879 | 0.00376879 | 0.00376879 | 0.00376879 | 0.00376879 |
| Hexane | 0.133944* | 0.133944 | 0.000813590 | 0.000813590 | 0.000813590 | 0.000813590 | 0.000813590 |
| Temperature ° F. | 120* | −74.6841 | −74.7642 | −74.7642 | −195* | −195.215 | −74.7642 |
| Pressure psia | 614.5* | 609.5 | 608.5 | 608.5 | 603.5 | 425* | 608.5 |
| Mole Fraction Vapor % | 100 | 95* | 100 | 100 | 0 | 0 | 100 |
| Std Vapor Volumetric Flow MMSCFD | 100* | 100 | 94.9975 | 52.1944 | 52.1944 | 52.1944 | 42.8031 |

| Mole Fraction/ Property - Stream No. | 38 | 42 | 44 | 46 | 48 | 52 | 56 |
|---|---|---|---|---|---|---|---|
| Nitrogen | 20.9263 | 20.9263 | 9.59387 | 4.84624 | 2.87481 | 2.87481 | 2.87481 |
| CO2 | 0.00479276 | 0.00479276 | 0.00165300 | 0.00494659 | 0.00631423 | 0.00631423 | 0.00631423 |
| Methane | 74.5651 | 74.5651 | 89.8808 | 90.7982 | 91.1792 | 91.1792 | 91.1792 |
| Ethane | 3.58786 | 3.58786 | 0.502344 | 3.49065 | 4.73153 | 4.73153 | 4.73153 |
| Propane | 0.756602 | 0.756602 | 0.0205138 | 0.711218 | 0.998029 | 0.998029 | 0.998029 |
| i-Butane | 0.0621838 | 0.0621838 | 0.000405626 | 0.0580783 | 0.0820266 | 0.0820266 | 0.0820266 |
| n-Butane | 0.0867579 | 0.0867579 | 0.000455393 | 0.0809976 | 0.114442 | 0.114442 | 0.114442 |
| i-Pentane | 0.00579575 | 0.00579575 | 3.26962E−06 | 0.00540297 | 0.00764517 | 0.00764517 | 0.00764517 |
| n-Pentane | 0.00376879 | 0.00376879 | 3.70709E−06 | 0.00351384 | 0.00497141 | 0.00497141 | 0.00497141 |
| Hexane | 0.000813590 | 0.000813590 | 1.39212E−07 | 0.000758359 | 0.00107321 | 0.00107321 | 0.00107321 |
| Temperature ° F. | −137.351* | −154.446 | −144.791 | −150.370 | −144.791 | −144.791 | −154.003 |
| Pressure psia | 603.5 | 421.273* | 418.5 | 418.5 | 418.5 | 418.5 | 345* |
| Mole Fraction Vapor % | 61.4339 | 64.9859 | 100 | 0 | 0 | 0 | 8.75183 |
| Std Vapor Volumetric Flow MMSCFD | 42.8031 | 42.8031 | 29.9047 | 101.922 | 72.0169 | 32.0169 | 32.0169 |

| Mole Fraction/ Property - Stream No. | 58 | 60 | 64 | 66 | 68 | 269 | 271 |
|---|---|---|---|---|---|---|---|
| Nitrogen | 2.87481 | 2.87481 | 2.87481 | 2.87481 | 2.87481 | 2.87481 | 2.87481 |
| CO2 | 0.00631423 | 0.00631423 | 0.00631423 | 0.00631423 | 0.00631423 | 0.00631423 | 0.00631423 |
| Methane | 91.1792 | 91.1792 | 91.1792 | 91.1792 | 91.1792 | 91.1792 | 91.1792 |
| Ethane | 4.73153 | 4.73153 | 4.73153 | 4.73153 | 4.73153 | 4.73153 | 4.73153 |
| Propane | 0.998029 | 0.998029 | 0.998029 | 0.998029 | 0.998029 | 0.998029 | 0.998029 |
| i-Butane | 0.0820266 | 0.0820266 | 0.0820266 | 0.0820266 | 0.0820266 | 0.0820266 | 0.0820266 |
| n-Butane | 0.114442 | 0.114442 | 0.114442 | 0.114442 | 0.114442 | 0.114442 | 0.114442 |
| i-Pentane | 0.00764517 | 0.00764517 | 0.00764517 | 0.00764517 | 0.00764517 | 0.00764517 | 0.00764517 |
| n-Pentane | 0.00497141 | 0.00497141 | 0.00497141 | 0.00497141 | 0.00497141 | 0.00497141 | 0.00497141 |
| Hexane | 0.00107321 | 0.00107321 | 0.00107321 | 0.00107321 | 0.00107321 | 0.00107321 | 0.00107321 |
| Temperature ° F. | 102.756 | −144.791 | −185.758 | 102.757* | −144.791 | −213.887 | −194.720 |
| Pressure psia | 340 | 418.5 | 165* | 160 | 418.5 | 75* | 72.5 |
| Mole Fraction Vapor % | 100 | 0 | 27.2528 | 100 | 0 | 38.0720 | 89.8426 |
| Std Vapor Volumetric Flow MMSCFD | 32.0169 | 10* | 10 | 10 | 30* | 30 | 30 |

TABLE 3-continued

FLOW STREAM PROPERTIES FOR EXAMPLE 2 - SYSTEM 210

| Mole Fraction/ Property - Stream No. | 80 | 84 | 86 | 289 | 298 | 302 |
|---|---|---|---|---|---|---|
| Nitrogen | 61.6377 | 47.9156 | 77.4962 | 77.4962 | 77.4962 | 77.4962 |
| CO2 | 0.000263415 | 0.000469946 | 2.47286E−05 | 2.47286E−05 | 2.47286E−05 | 2.47286E−05 |
| Methane | 38.2840 | 51.9416 | 22.5000 | 22.5000 | 22.5000 | 22.5000 |
| Ethane | 0.0759625 | 0.138410 | 0.00379258 | 0.00379258 | 0.00379258 | 0.00379258 |
| Propane | 0.00202842 | 0.00377091 | 1.46279E−05 | 1.46279E−05 | 1.46279E−05 | 1.46279E−05 |
| i-Butane | 2.96717E−05 | 5.53060E−05 | 4.62839E−08 | 4.62839E−08 | 4.62839E−08 | 4.62839E−08 |
| n-Butane | 3.33338E−05 | 6.21379E−05 | 4.50275E−08 | 4.50275E−08 | 4.50275E−08 | 4.50275E−08 |
| i-Pentane | 1.10636E−07 | 2.06361E−07 | 6.17194E−12 | 6.17194E−12 | 6.17194E−12 | 6.17194E−12 |
| n-Pentane | 1.71614E−07 | 3.20085E−07 | 2.74717E−11 | 2.74717E−11 | 2.74717E−11 | 2.74717E−11 |
| Hexane | 7.36483E−09 | 1.37369E−08 | 6.35870E−13 | 6.35870E−13 | 6.35870E−13 | 6.35870E−13 |
| Temperature ° F. | −190.214 | −209.857 | −209.857 | −209.857 | −265* | −285.411 |
| Pressure psia | 415 | 415 | 415 | 415 | 412.5 | 70* |
| Mole Fraction Vapor % | 100 | 0 | 100 | 100 | 0 | 14.7122 |
| Std Vapor Volumetric Flow MMSCFD | 49.5392 | 26.5586 | 22.9806 | 18.9976 | 18.9976 | 18.9976 |

| Mole Fraction/ Property - Stream No. | 344 | 346 | 350 | 306 | 310 | 316 | 318 |
|---|---|---|---|---|---|---|---|
| Nitrogen | 77.4962 | 77.4962 | 77.4962 | 97.7679 | 97.7679 | 97.7679 | 97.7679 |
| CO2 | 2.47286E−05 | 2.47286E−05 | 2.47286E−05 | 5.10442E−09 | 5.10442E−09 | 5.10442E−09 | 5.10442E−09 |
| Methane | 22.5000 | 22.5000 | 22.5000 | 2.23207 | 2.23207 | 2.23207 | 2.23207 |
| Ethane | 0.00379258 | 0.00379258 | 0.00379258 | 7.74273E−07 | 7.74273E−07 | 7.74273E−07 | 7.74273E−07 |
| Propane | 1 46279E−05 | 1 46279E−05 | 1.46279E−05 | 5.11716E−11 | 5.11716E−11 | 5.11716E−11 | 5.11716E−11 |
| i-Butane | 4.62839E−08 | 4.62839E−08 | 4.62839E−08 | 0 | 0 | 0 | 0 |
| n-Butane | 4.50275E−08 | 4.50275E−08 | 4.50275E−08 | 2.72021E−14 | 2.72021 E−14 | 2.72021 E−14 | 2.72021 E−14 |
| i-Pentane | 6.17194E−12 | 6.17194E−12 | 6.17194E−12 | 0 | 0 | 0 | 0 |
| n-Pentane | 2.74717E−11 | 2.74717E−11 | 2.74717E−11 | 0 | 0 | 0 | 0 |
| Hexane | 6.35870E−13 | 6.35870E−13 | 6.35870E−13 | 0 | 0 | 0 | 0 |
| Temperature ° F. | −209.857 | −293.599* | −292.620 | −285.458 | −296.961 | −214.763 | 102.757* |
| Pressure psia | 415 | 410 | 75* | 72.5 | 20* | 19 | 18 |
| Mole Fraction Vapor % | 100 | 0 | 0 | 100 | 100 | 100 | 100 |
| Std Vapor Volumetric Flow MMSCFD | 3.98301* | 3.98301 | 3.98301 | 17.4079 | 17.4079 | 17.4079 | 17.4079 |

| Mole Fraction/ Property - Stream No. | 320 | 330 | 334 | 366 | 370 | 372 |
|---|---|---|---|---|---|---|
| Nitrogen | 32.4611 | 30.0413 | 42.3124 | 5.01559 | 5.01559 | 5.01559 |
| CO2 | 3.73729E−05 | 4.67684E−05 | 2.58363E−06 | 0.000136879 | 0.000136879 | 0.000136879 |
| Methane | 67.5333 | 69.9510 | 57.6875 | 94.9610 | 94.9610 | 94.9610 |
| Ethane | 0.00552599 | 0.00765791 | 7.95320E−05 | 0.0231132 | 0.0231132 | 0.0231132 |
| Propane | 2.11247E−05 | 4.56127E−05 | 1.11114E−08 | 0.000138612 | 0.000138612 | 0.000138612 |
| i-Butane | 6.68191E−08 | 2.67431E−07 | 2.41581E−12 | 8.12824E−07 | 8.12824E−07 | 8.12824E−07 |
| n-Butane | 6.50051E−08 | 3.21385E−07 | 2.00276E−12 | 9.76814E−07 | 9.76814E−07 | 9.76814E−07 |
| i-Pentane | 8.91010E−12 | 8.63913E−11 | 2.07022E−18 | 2.62578E−10 | 2.62578E−10 | 2.62578E−10 |
| n-Pentane | 3.96594E−11 | 3.99677E−10 | 6.00004E−17 | 1.21478E−09 | 1.21478E−09 | 1.21478E−09 |
| Hexane | 9.17972E−13 | 1.57875E−11 | 4.74668E−20 | 4.79843E−11 | 4.79843E−11 | 4.79843E−11 |
| Temperature ° F. | −269.184 | −236.193 | −236.193 | −236.193 | −236.241 | −217.466 |
| Pressure psia | 75 | 64 | 64 | 64 | 80* | 79 |
| Mole Fraction Vapor % | 0 | 67.0987 | 100 | 0 | 0 | 35.1102 |
| Std Vapor Volumetric Flow MMSCFD | 15.9185 | 15.4186 | 10.3457 | 5.07292 | 5.07292 | 5.07292 |

TABLE 3-continued

FLOW STREAM PROPERTIES FOR EXAMPLE 2 - SYSTEM 210

| Mole Fraction/ Property - Stream No. | 276 | 378 | 158 | 162 | 164 |
|---|---|---|---|---|---|
| Nitrogen | 3.18445 | 3.18445 | 2.40974 | 2.40974 | 2.40974 |
| CO2 | 0.00542075 | 0.00542075 | 0.00893552 | 0.00893552 | 0.00893552 |
| Methane | 91.7262 | 91.7262 | 38.6237 | 38.6237 | 38.6237 |
| Ethane | 4.05051 | 4.05051 | 17.5985 | 17.5985 | 17.5985 |
| Propane | 0.853695 | 0.853695 | 18.5315 | 18.5315 | 18.5315 |
| i-Butane | 0.0701625 | 0.0701625 | 5.08483 | 5.08483 | 5.08483 |
| n-Butane | 0.0978896 | 0.0978896 | 10.6742 | 10.6742 | 10.6742 |
| i-Pentane | 0.00653938 | 0.00653938 | 2.41214 | 2.41214 | 2.41214 |
| n-Pentane | 0.00425235 | 0.00425235 | 1.99434 | 1.99434 | 1.99434 |
| Hexane | 0.000917979 | 0.000917979 | 2.66208 | 2.66208 | 2.66208 |
| Temperature ° F. | −205.936 | 102.757* | −74.7642 | −109.565 | 102.757* |
| Pressure psia | 72.5 | 70 | 608.5 | 165* | 160 |
| Mole Fraction Vapor % | 84.6009 | 100 | 0 | 27.8845 | 93.1194 |
| Std Vapor Volumetric Flow MMSCFD | 35.0729 | 35.0729 | 5.00253 | 5.00253 | 5.00253 |

It will be appreciated by those of ordinary skill in the art that these values in Example 2 are based on the particular parameters and composition of the feed stream in the above computer simulation example. The temperature, pressure, and compositional values will differ depending on the parameters and composition of the NRU Feed stream 12 and specific operating parameters for various pieces of equipment in system 210.

For inlet feed conditions in Example 1 or in Example 2, a prior art single column design would require around 11,000 hp (or around 110 hp per inlet feed MMSCF of gas); however, a preferred embodiment of the invention according to FIG. 1 or FIG. 2 can process that inlet gas feed stream using only 6,650 hp, which is around 60% of the horsepower required in the prior art system. That difference equates to around $4,300,000 in installed cost plus the added fuel demand that are saved using a preferred embodiment of the invention as depicted in FIG. 1 over prior art single column designs. The operating cost savings over the capital cost differential between a prior art single column and two column system according to the preferred embodiment in FIG. 1 would be around 25% of the total installed costs.

When nitrogen levels are around 20% (as in Examples 1 and 2), it is preferred to use system 210 and the corresponding method described herein, which has less complex process flows, requires fewer pieces of equipment, and generally results in a low pressure sales gas stream with a higher pressure than in system 10. However, system 10 is preferred when nitrogen content of feed stream 12 is substantially above 20%, most preferably around 40 to 75%.

According to another preferred embodiment, a natural gas expander may be used in place of valve 108 in either system 10 or system 210, which would provide a higher degree of cooling of the second column overhead stream than with the valve alone. For example, where the differential across the valve (stream 106 to stream 110 or stream 306 to 310) is calculated to be approximately 10° F., the differential across an expander is approximately 37° F. This higher degree of cooling results in a slightly higher purity of nitrogen to be vented in stream 118 or stream 318 of approximately 0.5 to 1 percent higher nitrogen quality than when a valve 108 alone is used, but also significantly reduces the residue compression required. With a standard control valve in the position of valve 108 the amount of compression is calculated to be approximately 66.5 BHP/MMSCF of inlet gas. The calculated residue HP required with the expander in place instead of the valve 108 is approximately 56.4 BHP/MMSCF. This represents a near 18% reduction in compression HP along with the associated reduction in fuel or power and the associated reduction in environmental impact.

A downflow, knockback condenser 482 may also be used to provide heat exchange in the fourth heat exchanger in systems 10 and 210. A downflow, knockback condenser and method of use as disclosed herein that are particularly useful for partially condensing a vapor stream so that a lighter gas fraction can be efficiently removed and separated from the liquid that is condensed from the vapor stream. The term "lighter" refers to the actual density of the vapor constituent as compared to the liquid constituent density that may be present at any point in the knockback condenser. The knockback condenser and method are particularly useful for separating gaseous nitrogen from condensed natural gas liquid.

A principal distinction between the knockback condenser described herein and condensers disclosed in the prior art is the provision and use of a vapor riser to introduce vapor captured from the fractionation section of a tower into a headspace above a tubular heat exchanger section to thereby establish downflow or countercurrent cooling of the vapor within the tubes of the condenser to partially condense it into a condensed liquid fraction from which a remaining uncondensed gaseous fraction is then separated and removed.

According to one preferred embodiment, a knockback condenser is useful for partially condensing vapor in the upper section of the first fractionation column to separate vapor and a lighter gaseous fraction (as an overhead stream from the first fractionation column) from a condensed liquid component (as a reflux stream for the first fractionation column). The knockback condenser preferably comprises a substantially cylindrical shell and a condenser section having upper and lower tube sheets attached transversely to the inside of the shell. The tube sheets support a plurality of spaced-apart, vertically oriented, heat exchange tubes extending between the upper and lower tube sheets to provide fluid communication through the tubes. Refrigerant inlet and outlet ports are preferably and desirably disposed so as to establish a generally upward flow of refrigerant around the heat exchange tubes between the lower and upper tube sheets. A vapor riser provides fluid communication between a space in the fractionation tower disposed below the liquid trap plate and a headspace disposed above the upper tube sheet, thereby establishing an upward flow of vapor through the riser and a downward flow of vapor, condensed liquid and an uncondensed, lighter gaseous fraction through the heat exchange tubes. As a refrigerant stream (such as stream 124 or 269) flows through the shell around the tubes, it sufficiently cools the tubes to condense natural gas passing downwardly through the tubes, thereby liquefying the natural gas and separating it from the gaseous nitrogen.

A vapor outlet port is preferably disposed below the lower tube sheet to receive the lighter gaseous fraction and any remaining vapor exiting the lower tube sheet. Liquid collection and recovery apparatus disposed below the lower tube sheet and below the vapor outlet port receive liquid condensed from the vapor.

According to another preferred embodiment, a method for partially condensing a vapor stream from an upper level or zone of the first fractionating column to separate a lighter gaseous fraction from a condensed liquid fraction, comprises the steps of providing a condenser having a substantially cylindrical, vertically oriented shell; upper and lower tube sheets attached transversely to the inside of the shell, the tube sheets supporting a plurality of spaced-apart, vertically oriented, heat exchange tubes extending between the upper and lower tube sheets, and providing fluid communication through the tubes; providing refrigerant inlet and outlet ports disposed in the shell so as to establish a generally upward flow of refrigerant around the heat exchange tubes between the lower and upper tube sheets; providing a vapor riser providing fluid communication between a space in the shell disposed below the lower tube sheet and a headspace disposed above the upper tube sheet; establishing an upward flow of vapor through the riser and a downward flow comprising vapor, condensed liquid fraction and lighter gaseous fraction through the heat exchange tubes, the refrigerant having sufficient cooling capacity to condense a desired liquid fraction from the vapor while passing through the heat exchange tubes; and separately recovering the lighter gaseous fraction from the condensed liquid fraction collected below the heat exchange tubes.

Through use of a knockback condenser and method disclosed herein, one is able to achieve more predictable condenser performance, improved plant flexibility; higher sales gas recoveries, and lower capital costs. Greater predictability in condenser performance is particularly significant for meeting performance guarantees required by gas plant owners, especially for larger plants, where specific component performance plays a significant role in overall plant design.

In the previous condenser designs, such as in Applicant's prior U.S. Pat. Nos. 5,275,505 and 5,375,422 that utilize an internal condenser in a single column nitrogen rejection system, the gas enters at the bottom of the tubes and exits at the top, whereas with the knockback condenser herein, the gas enters at the top of the tubes and exits at the bottom. The performance improvement arises from the fact that some of the gas entering the tubes is condensed, regardless of gas flow direction. In the vapor up-flow models, the liquid must exit by flowing downward or counter-current to the gas flow. While this was anticipated in the design of the prior art condensers, Applicant learned from their use that the "falling" liquid creates a film that negatively affects the heat transfer coefficient, requiring more condenser surface area to be installed with each condenser application and adding complexity to the estimation of condenser performance.

Figure 3:
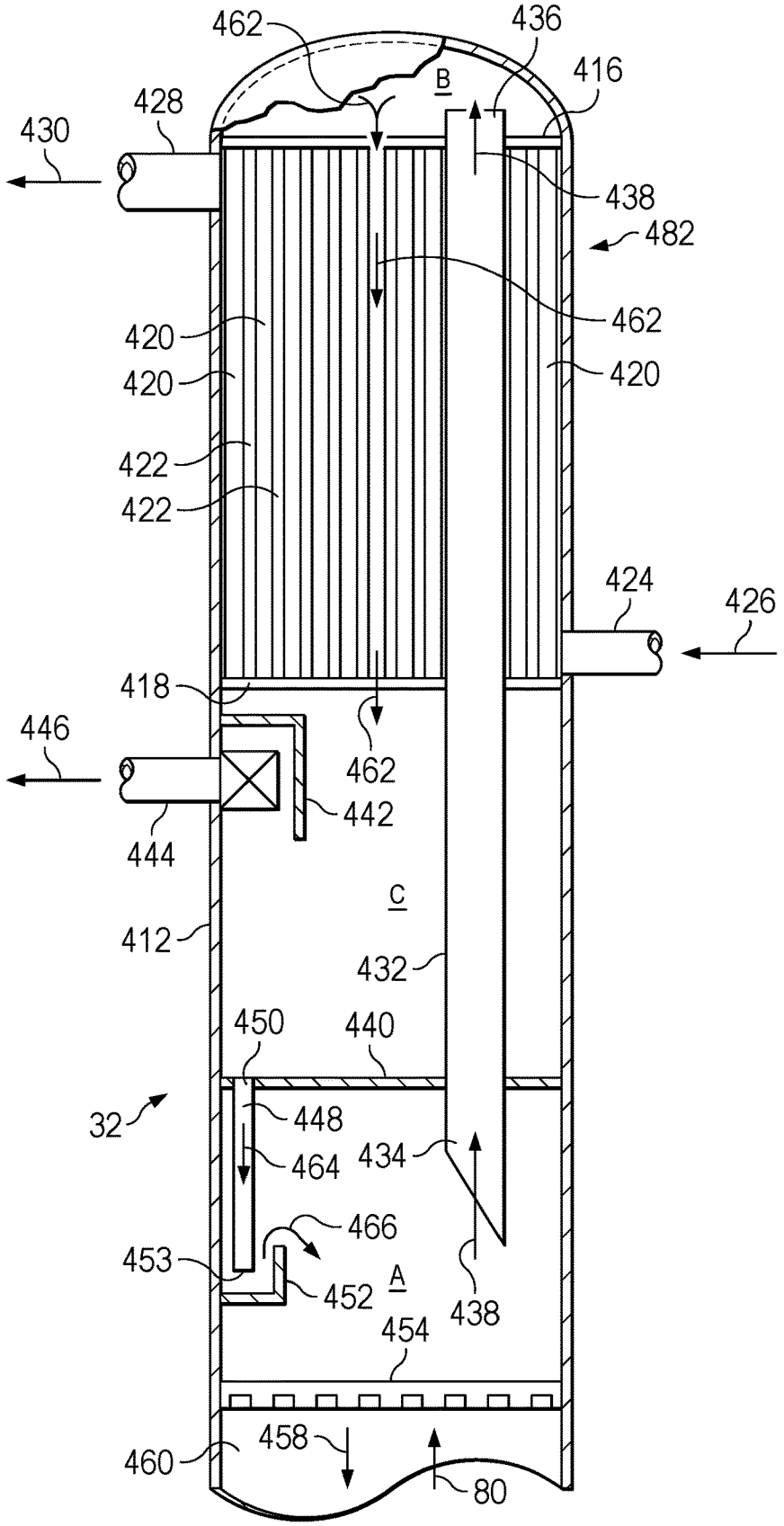
FIG. 3 is a simplified cross-sectional elevation view of a preferred downflow knockback condenser that may be used with systems and methods of FIGS. 1 and 2.

In contrast, a downflow, knockback condenser utilizes a vapor riser to introduce a flow of vapor into a headspace above a vertical tubular heat exchanger, thereby establishing a downflow of condensed liquid and a lighter gaseous fraction through the heat exchange tubes. Referring to FIG. 3, an upper portion of a first fractionation tower or column 32 is shown in which the upper portion of the column shell 412 contains a preferred embodiment of downflow, knockback condenser 482 to provide heat exchange. Fractionation column 32 is preferably made of conventional materials capable of operating at the temperatures and pressures needed for a particular application, and has a nominal diameter ranging from about 18 to about 120 inches, depending upon plant size and throughput. Generally speaking, the fractionation section of fractionation column 32 is disposed below section 460, and is broken away to facilitate enlargement of the upper section of the tower in which condenser 482 resides. As shown in the embodiment depicted in FIG. 3, section 460 of fractionation column 32 is separated by liquid distribution plate 454 from the gas and condensed liquid recovery zones disposed between section 460 and condenser 482. Liquid distribution plate 454 allows rich vapor 80 rising upwardly from the fractionation section to enter the condenser section of the tower, and distributes condensed liquid recovered from condenser 482 as further described below to pass downwardly as reflux liquid 84 into the fractionation section of the tower, as indicated by arrow 458, countercurrent to the upwardly rising rich vapor 80.

As used herein, the term "condenser section" collectively refers to Zones A, B and C and shown in FIG. 3. In Zone A, rich vapor rising upwardly from the fractionation section 460, such as vapor stream 80 from a top portion of column 32, through liquid distribution plate 454 enters riser 432 and is directed upwardly into the headspace designated as Zone B above condenser 482. From Zone B, as indicated by arrows 462, the rich vapor flows downwardly through upper tube sheet 416 into the plurality of substantially vertical heat exchange tubes 420, which are cooled by refrigerant entering shell 412 through refrigerant inlet 424 as shown by arrow 426. The source of refrigerant in system 10 when knockback condenser 482 is used is preferably stream 124, which is a first portion of the bottoms stream 120 from second column 104. Stream 124 preferably feeds into refrigerant inlet 424 by gravity feed, as it does with exchanger 82 (shell). The source of refrigerant in system 210 when knockback condenser 482 is used is preferably stream 269, which is a third portion of the bottoms stream 48 from first column 32. The refrigerant flows around heat exchange tubes 420 through spaces 422 and, as it absorbs heat from tubes 420, eventually rises to a point where it exits outlet 428 as indicated by arrow 430. Refrigerant stream 124 in system 10 exits as stream 126 and then proceeds to preferably be mixed with streams 184 and 156 as shown in FIG. 1. Refrigerant stream 269 in system 210 exits as stream 271 and then proceeds to preferably be mixed with stream 372 as shown in FIG. 2.

As condensed liquid and an uncondensed gaseous fraction exit downwardly from tubes 420 through lower tube sheet 418 into Zone C, the gaseous fraction exits shell 212 through outlet 444 as indicated by arrow 446, and the condensed liquid is collected on liquid trap plate 440. From liquid trap plate 440, the condensed liquid received into Zone C from condenser 482 flows downwardly through opening 450, through reflux liquid return seal leg 448, as shown by arrow 464, where it is discharged from end 453 into reflux seal pan 452 in Zone A. From reflux seal pan 452, the condensed reflux liquid spills over, as shown by arrow 466, onto liquid distribution plate 454, from which it is returned to the fractionation section as indicated by arrow 458.

The design, structure and general operation of a preferred embodiment of downflow, knockback condenser 482 is further described and explained below in relation to a computer simulation wherein rich vapor containing natural gas (methane) and nitrogen is partially condensed to separate and remove the gaseous nitrogen from the condensed natural gas liquid. The reference numerals used below generally relate to the structures and flows as described above in relation to FIG. 3.

Zone A contains both vapor and liquid. The vapor enters Zone A from section 460 of the fractionation tower via liquid distribution tray 454 disposed below liquid trap plate 440. The liquid enters Zone A from condenser 482 above via the reflux liquid return seal leg 448. The Zone A vapor component is expected to exist at the temperature, pressure and composition given below, and is at the dew point of the rich vapor, meaning that any reduction in temperature at the same pressure will create liquid condensate. In a computer simulation of fractionation column 32 (operated generally, not specifically with respect to systems 10 or 210) as operated with the downflow knockback condenser 482 of a preferred embodiment, the Zone A vapor and liquid conditions are as follows:

| Zone A Vapor (Entering) | |
|---|---|
| Temperature (deg. F.) | −245.46 |
| Pressure (psia) | 315.00 |
| Component (mole %) | |
| Nitrogen | 97.54 |
| Methane | 2.46 |
| Zone A Liquid (Entering) | |
| Temperature (deg. F.) | −247.52 |
| Pressure (psia) | 315.00 |
| Component (mole %) | |
| Nitrogen | 98.4570 |
| Methane | 1.5430 |

The liquid in Zone A provides the reflux for fractionation column 32 to minimize the amount of methane that is vented with the nitrogen waste gas through outlet 444. The vapor from Zone A proceeds upward through the vapor riser 432 into Zone B. Entrance 434 to vapor riser 432 is preferably cut obliquely on a 60 degree bias to provide greater entrance area to riser 432 and thereby reduce the entrance velocity and associated pressure losses of the rich vapor. Reducing the velocity at entrance 434 allows less liquid, in the form of droplets, to enter riser 432. Some liquid droplets entering riser 432 will not significantly impair the performance of fractionation column 32 or condenser 482, but neither does it help. The entrance of riser 432 is desirably spaced approximately one foot from the underside of liquid trap plate 440 to reduce the vapor velocity at the lower or bottom face of liquid trap plate 440. Lowering this velocity will help minimize the heat transfer across the plate. Heat transfer across liquid trap plate 440 is not desirable because it will reduce the overall effectiveness of condenser 482, and should be minimized. Upper end 436 of vapor riser 432 is desirably extended about six inches above upper tube sheet 416. This extension will help in more evenly distributing the vapor flow across upper tube sheet 416.

The section between upper tube sheet 416 and lower tube sheet 418 is the principal heat exchanger section of condenser 482. A primary point of distinction between this invention and some prior art systems and methods is that, in this disclosure, a flow direction of the vapor to be cooled through the heat exchange section is reversed. In some prior art systems, the gas enters at the bottom of the heat exchange tubes and exits at the top, whereas with the present design, the gas enters at the top of heat exchange tubes 420 and exits at the bottom.

The Zone B vapor conditions are substantially the same as in Zone A but there is no liquid present. In reality, the temperature in Zone B is slightly lower than in Zone A and the computer predicts a slight temperature decrease and a lower pressure due to the vertical elevation difference between Zone A and Zone B. The temperature differences here are insignificant in the overall operation of the unit, but the pressure drop is significant, as is further explained below. Any temperature reduction in riser 432 is beneficial, but a conservative approach plans for minimal temperature decrease and only as predicted by the computer simulations. The Zone B vapor conditions are as follows:

| Zone B Vapor | |
|---|---|
| Temperature (deg. F.) | −245.56 |
| Pressure (psia) | 314.09 |
| Component (mole %) | |
| Nitrogen | 97.54 |
| Methane | 2.46 |

Condenser 482 is desirably mounted on the top of fractionation column 32 approximately 70 feet from grade. Condenser 482 is preferably a shell and tube heat exchanger configured with substantially vertical tubes 420 supported at the ends by the upper and lower tube sheets 416, 418, respectively. Heat exchange tubes 420 provide the heat transfer surface between the refrigerant, on the shell side, and the process vapor on the tube side. The shell side of the exchanger is isolated from the tube side as a different process fluid is present on that side. The refrigerant used on the shell side of the condenser is preferably LNG created from a tower bottom source. In one preferred embodiment, the refrigerant stream comprises stream 124 (a portion of the second column bottoms stream). In another preferred embodiment, the refrigerant stream comprises stream 269 (a portion of the first column bottoms stream). The refrigerant stream desirably enters condenser 482 through a nozzle at inlet 424 in shell 412 and exits shell 412 through a nozzle at outlet 428.

The approximate conditions of the refrigerant entering inlet 424 of condenser 482 in one example are as follows:

| Inlet Refrigerant | |
|---|---|
| Temperature (deg. F.) | −254.75 |
| Pressure (psia) | 21.88 |
| Vapor mole fraction | 0.095 |

-continued

| Component (mole %) | |
|---|---|
| Nitrogen | 4.00 |
| Methane | 84.81 |
| Ethane | 8.62 |
| Propane | 2.17 |
| I-Butane | 0.09 |
| N-Butane | 0.24 |
| I-Pentane | 0.02 |
| N-Pentane | 0.04 |
| N-Hexane | 0.00724 |
| N-Heptane | 0.0019 |

The approximate conditions of the refrigerant exiting condenser 482 at outlet 428 based on the above example are as follows:

| Exit Refrigerant | |
|---|---|
| Temperature (deg. F.) | −247.47 |
| Pressure (psia) | 18.57 |
| Vapor mole fraction | 0.641 |
| Component (mole %) | |
| Nitrogen | 4.00 |
| Methane | 84.81 |
| Ethane | 8.62 |
| Propane | 2.17 |
| I-Butane | 0.09 |
| N-Butane | 0.24 |
| I-Pentane | 0.02 |
| N-Pentane | 0.04 |
| N-Hexane | 0.0072 |
| N-Heptane | 0.0019 |

It should be noted that the temperature is slightly higher on the exiting stream, but, and this is of greater significance, that the vapor fraction is much greater on the exiting stream. Because the temperatures of the refrigerant streams entering and exiting the heat exchanger are lower than the vapor inside the vertical tubes 420, heat will be transferred from the process vapor from Zone B into the refrigerant.

The fluid next passes from Zone B into Zone C through condenser 482, where the temperature is reduced. As stated before, the condition of the vapor in Zone B is at the dew point, which means that any reduction in temperature will produce condensate from the entering vapor.

The conditions of the fluid stream entering Zone C from condenser 482 in this example are as follows:

| Zone C Entering Vapor and Liquid Mixture | |
|---|---|
| Temperature (deg. F.) | −247.55 |
| Pressure (psia) | 314.30 |
| Vapor mole fraction | 0.25 |
| Component (mole %) | |
| Nitrogen | 97.54 |
| Methane | 2.46 |

Completing the circuit, the vapor part of the fluid stream exiting from heat exchange tubes 420 at the lower tube sheet exits the unit at vapor fraction outlet 444, from which liquid is preferably shielded by liquid barrier 442, and the condensed liquid component falls to liquid trap plate 440 where it flows by gravity through inlet 450 into reflux liquid return seal leg 448, and from there into reflux seal pan 452. The purpose of the seal leg 448 is to provide a liquid head created by standing liquid in the seal leg to offset the pressure loss in moving the vapor from Zone A into Zone B and eventually into Zone C. The pressure drop through the total circuit is critical and is held to approximately 0.70 psi. The standing liquid in seal leg 448 creates this differential by using gravity and the higher density of the liquid component as compared to the same compounds as vapor. Reflux seal pan 452 provides a liquid trapping mechanism to prevent flow of the vapor in Zone A from flowing directly up seal leg 448 and bypassing condenser 482. Under normal operating conditions, the liquid level is anticipated to be approximately 1 foot deep on top of liquid trap plate 440.

It will also be appreciated by those of ordinary skill in the art upon reading this disclosure that references to separation of nitrogen and methane used herein refer to processing an NRU feed gas to produce various multi-component product streams containing large amounts of the particular desired component, but not pure streams of any particular component. One of those product streams is a nitrogen vent stream, which is primarily comprised of nitrogen but may have small amounts of other components, such as methane and ethane. Other product streams are processed gas streams, or sales gas streams, which are primarily comprised of methane but may have small amounts of other components, such as nitrogen, ethane, and propane. Amounts of components in the various streams described herein as a percentage are mole fraction percentage. All numeric range values indicated herein include each individual numeric value within those ranges and any and all subset combinations within ranges, including subsets that overlap from one preferred range to a more preferred range.

It will also be appreciated by those of ordinary skill in the art upon reading this disclosure that additional processing sections for removing carbon dioxide, water vapor, and possibly other components or contaminants that are present in the NRU feed stream, can also be included in the system and method of the invention, depending upon factors such as, for example, the origin and intended disposition of the product streams and the amounts of such other gases, impurities or contaminants as are present in the NRU feed stream. Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A NRU system for separating nitrogen from methane and heavier hydrocarbons to produce a methane product stream, the NRU system comprising:

a first fractionating column wherein at least a first feed stream comprising nitrogen, methane, and heavier hydrocarbons is separated into a first vapor stream and a first column bottoms stream;

a first splitter for splitting the first column bottoms stream into a first portion, a second portion, and a third portion;

a second fractionating column wherein at least a first column overhead stream is separated into a second column overhead stream and a second column bottoms stream;

a first heat exchanger wherein the first feed stream is cooled upstream of the first fractionating column through heat exchange with a first set of heat exchange streams comprising the second column overhead stream, the first portion of the first column bottoms stream, the second portion of the first column bottoms stream, and the third portion of the first column bottoms stream;

a second heat exchanger wherein the first vapor stream from an upper fractionation zone of the first fractionating column is cooled and partially condensed through heat exchange with a refrigerant stream to produce the first column overhead stream and a reflux stream that is returned to the first fractionating column;

wherein the methane product stream comprises the first portion of the first column bottoms stream, the second portion of the first column bottoms stream, and the third portion of the first column bottoms stream;

wherein the refrigerant stream comprises the third portion of the first column bottoms stream; and wherein the second column overhead stream comprises 98% or more nitrogen.

2. The NRU system of claim 1 wherein the second heat exchanger comprises a first shell and tube heat exchanger comprising a tube side and a shell side, and wherein the first vapor stream is on the tube side and the refrigerant stream is on the shell side;

wherein an amount of methane in the first feed stream on a mole fraction basis is substantially higher than an amount of heavier hydrocarbons in the first feed stream; and wherein the reflux stream comprises (1) an amount of nitrogen that is greater on a mole fraction basis than an amount of nitrogen in the first feed stream and (2) an amount methane that is less on a mole fraction bases than the amount of methane in the first feed stream.

3. The NRU system of claim 2 wherein the tube side of the second heat exchanger comprises a plurality of tubes disposed inside the shell side of the second heat exchanger and wherein the plurality of tubes are oriented substantially vertically.

4. The NRU system of claim 3 wherein the second heat exchanger is external to the first fractionating column and external to the second fractionating column.

5. The NRU system of claim 1 wherein the second heat exchanger is external to the first fractionating column and external to the second fractionating column.

6. The NRU system of claim 3 wherein the refrigerant stream comprises at least a first portion of the second column bottoms stream.

7. The NRU system of claim 1 wherein a second feed stream also comprising nitrogen, methane, and heavier hydrocarbons is also separated into the first vapor stream and the first column bottoms stream in the first fractionating column;

wherein the second feed stream feeds into the first fractionating column as a mixed liquid and vapor stream at a second level lower than a first level where the first feed stream feeds into the first fractionating column as a liquid stream.

8. The NRU system of claim 7 further comprising a reboiler for the first fractionating column wherein a liquid stream from a lower fractionation zone of the first fractionating column is warmed and partially vaporized into a second vapor stream through heat exchange with the second feed stream and wherein the second vapor stream is returned to the first fractionating column; and wherein the second feed stream is cooled in the reboiler prior to feeding into the first fractionating column.

9. The NRU system of claim 8 wherein the reboiler comprises a second shell and tube heat exchanger comprising a tube side and a shell side, wherein the second feed stream is on the tube side of the reboiler and the liquid stream is on the shell side of the reboiler.

10. The NRU system of claim 6 wherein the refrigerant stream comprises a higher vapor mole fraction percentage when it exits the second heat exchanger than when it entered the second heat exchanger.

11. The NRU system of claim 6 wherein the refrigerant stream is substantially in vapor form when it exits the second heat exchanger and is substantially in liquid form when it enters the second heat exchanger.

12. The NRU system of claim 1 further comprising:

a second splitter for splitting the first column overhead stream upstream of the second fractionating column into a first portion of the first column overhead stream and a second portion of the first column overhead stream;

a third heat exchanger for subcooling the first portion of the first column overhead stream by at least 40° F. upstream of feeding into a too level of the second fractionating column through heat exchange with the second column overhead stream upstream of the first heat exchanger.

13. The NRU system of claim 12 further comprising a fourth heat exchanger wherein the second portion of the first column overhead stream is cooled upstream of feeding into the top level of the second fractionating column through heat exchange with a second set of heat exchange streams comprising the second column bottoms stream.

14. The NRU system of claim 13 further comprising a first separator wherein the second column bottoms stream downstream of the fourth heat exchanger is separated into a first separator overhead stream and a first separator bottoms stream; and wherein the first separator overhead stream feeds into a bottom fractionation level of the second fractionating column;

wherein the methane product stream further comprises the first separator bottoms stream; and wherein the second set of heat exchange streams further comprises the first separator bottoms stream.

15. The NRU system of claim 14 further comprising:

a second separator for separating a system feed stream into a second separator overhead stream and a second separator bottoms stream;

a third splitter to split the second separator overhead stream into the first feed stream and a second feed stream also comprising nitrogen, methane, and heavier hydrocarbons and wherein the second feed stream is also separated into the first vapor stream and the first column bottoms stream in the first fractionating column; and wherein the first set of heat exchange streams further comprises the first separator bottoms stream downstream of the fourth heat exchanger and the second separator bottoms stream.

16. The NRU system of claim 15 wherein the system feed stream is cooled in the first heat exchanger upstream of the second separator and wherein the first portion of the first column overhead stream is subcooled by at least 60° F. in the third heat exchanger upstream of feeding into the second fractionating column.

17. The NRU system of claim 16 wherein the second heat exchanger is external to the first fractionating column and external to the second fractionating column.

18. The NRU system of claim 17 further comprising a reboiler for the first fractionating column wherein a liquid stream from a lower fractionation zone of the first fractionating column is warmed and partially vaporized into a second vapor stream through heat exchange with the second feed stream upstream of the second feed stream feeding into the first fractionating column and wherein the second vapor stream is returned to the first fractionating column.

19. The NRU system of claim 1 wherein the second heat exchanger comprises a knockback condenser.

20. The NRU system of claim 2 wherein the first shell and tube heat exchanger comprises a knockback condenser.

21. The NRU system of claim 19 wherein the knockback condenser comprises:

a plurality of heat exchange tubes disposed inside a shell space;

a headspace zone disposed above and in fluid communication with the plurality of heat exchange tubes;

a riser tube configured to allow fluid communication of the first vapor stream from the upper fractionation zone of the first fractionating column to the headspace zone; and a refrigerant inlet and a refrigerant outlet to allow fluid communication of the refrigerant stream through the shell space.

22. The NRU system of claim 21 wherein the knockback condenser further comprises:

an intermediate zone disposed below the plurality of heat exchange tubes, the intermediate zone configured to receive a mixed stream comprising a vapor portion and a liquid portion from the plurality of heat exchange tubes and allow the liquid portion to separate from the vapor portion by gravity, the intermediate zone comprising a first outlet for the vapor portion of the mixed stream and a second outlet for the liquid portion of the mixed stream;

a lower zone disposed between the intermediate zone and the upper fractionation zone of the first fractionating column, the lower zone configured to receive the liquid portion from the intermediate zone through the second outlet and comprising a liquid distribution plate configured to distribute the liquid portion to the upper fractionation zone of the first fractionating column;

wherein the vapor portion of the mixed stream is the first column overhead stream and the liquid portion of the mixed stream is the reflux stream; and wherein the plurality of heat exchange tubes are oriented substantially vertically, each having an inlet end in fluid communication with the headspace zone to receive the first vapor stream and an outlet end in fluid communication with the intermediate zone.

23. The NRU system of claim 22 wherein the refrigerant inlet is disposed below the refrigerant outlet.

24. The NRU system of claim 21 wherein the refrigerant inlet is disposed below the refrigerant outlet.

25. The NRU system of claim 19 further comprising:

a second splitter for splitting the first column overhead stream upstream of the second fractionating column into a first portion of the first column overhead stream and a second portion of the first column overhead stream;

a third heat exchanger for cooling the first portion of the first column overhead stream upstream of feeding into the second fractionating column through heat exchange with the second column overhead stream upstream of the first heat exchanger.

26. The NRU system of claim 25 further comprising a fourth heat exchanger wherein the second portion of the first column overhead stream is cooled upstream of feeding into the second fractionating column through heat exchange with a second set of heat exchange streams comprising the second column bottoms stream.

27. The NRU system of claim 26 further comprising a first separator wherein the second column bottoms stream downstream of the fourth heat exchanger is separated into a first separator overhead stream and a first separator bottoms stream; and wherein the first separator overhead stream feeds into a bottom fractionation level of the second fractionating column;

wherein the second set of heat exchange streams further comprises the first separator bottoms stream; and wherein the methane product stream further comprises the first separator bottoms stream.

28. The NRU system of claim 27 further comprising:

a second separator for separating a system feed stream into a second separator overhead stream and a second separator bottoms stream;

a third splitter to split the second separator overhead stream into the first feed stream and a second feed stream;

wherein the second feed stream also comprises nitrogen, methane, and heavier hydrocarbons and is also separated into the first vapor stream and the first column bottoms stream in the first fractionating column; and wherein the first set of heat exchange streams further comprises the first separator bottoms stream downstream of the fourth heat exchanger and the second separator bottoms stream.

29. The NRU system of claim 28 wherein the system feed stream is cooled in the first heat exchanger upstream of the second separator;

wherein an amount of methane in the first feed stream on a mole fraction basis is substantially higher than an amount of heavier hydrocarbons in the first feed stream; and wherein the reflux stream comprises (1) an amount of nitrogen that is greater on a mole fraction basis than an amount of nitrogen in the first feed stream and (2) an amount methane that is less on a mole fraction bases than the amount of methane in the first feed stream.

30. The NRU system of claim 21 wherein a second feed stream that also comprises nitrogen, methane, and heavier hydrocarbons is also separated into the first column overhead stream and the first column bottoms stream in the first fractionating column;

wherein the second feed stream feeds into the first fractionating column as a mixed liquid and vapor stream at a second level lower than a first level where the first feed stream feeds into the first fractionating column as liquid stream.

31. The NRU system of claim 30 further comprising a reboiler for the first fractionating column wherein a liquid stream from a lower fractionation zone of the first fractionating column is warmed and partially vaporized through heat exchange with the second feed stream to produce the first column bottoms stream and a second vapor stream that is returned to the first fractionating column; and wherein the second feed stream is cooled in the reboiler prior to feeding into the first fractionating column.

32. The NRU system of claim 31 wherein the reboiler comprises a second shell and tube heat exchanger comprising a tube side and a shell side, wherein the second feed stream is on the tube side of the reboiler and the liquid stream is on the shell side of the reboiler.

33. The NRU system of claim 32 wherein the refrigerant stream comprises a first vapor mole fraction percentage when it enters the refrigerant inlet and a second vapor mole fraction percentage when it exits the refrigerant outlet; and wherein the first vapor mole fraction percentage is substantially equal to the second vapor mole fraction percentage.

34. The NRU system of claim 19 wherein the second fractionating column is stacked on the first fractionating column.

35. The NRU system of claim 19 wherein the first fractionating column is operated at a pressure between 315 and 415 psia and the second fractionating column is operated at a pressure between 65 and 115 psia.

36. The NRU system of claim 19 wherein the first heat exchanger comprises a single plate-fin heat exchanger.

37. The NRU system of claim 28 wherein the system feed stream comprises 20-50% nitrogen on a mole fraction basis.

38. The NRU system of claim 1 wherein the NRU system is configured to produce the second column overhead stream based on a system feed stream comprising 20 or less nitrogen on a mole fraction basis.

39. The NRU system of claim 1 wherein heat exchange in the first heat exchanger occurs simultaneously between each of the first feed stream and the first set of heat exchange streams; and wherein the first heat exchanger comprises a single plate-fin heat exchanger.

40. The NRU system of claim 1 wherein the methane product stream has a first volumetric flow rate and wherein the first column bottoms stream has a second volumetric flow rate that is more than 50% of the fir volumetric flow rate.

41. The NRU system of claim 1 wherein the methane product stream further comprises, as a minor portion, the second column bottoms stream after the second column bottoms stream is further processed downstream of the second fractionating column.

42. The NRU system of claim 1 wherein a major portion of the methane product stream is the first column bottoms stream.

43. The NRU system of claim 1 wherein the second heat exchanger comprises a vertical tube, falling film condenser.

44. The NRU system of claim 1 further comprising one or more compressors to compress the methane product stream and wherein the NRU system has an energy requirement for the one or more compressors of around 55 to 75 HP per MMSCFD of a system feed stream volume.

45. The NRU system of claim 1 wherein the methane product stream comprises less than 2% total nitrogen.

46. The NRU system of claim 18 wherein the reboiler comprises a shell and tube heat exchanger comprising a tube side and a shell side, wherein the second feed stream is on the tube side of the reboiler and the liquid stream is on the shell side of the reboiler.

47. The NRU system of claim 46 further comprising a mixer for mixing the first separator bottoms stream downstream of the fourth heat exchanger with the third portion of the first column bottoms stream downstream of the second heat exchanger to form a mixed stream; and wherein the first set of heat exchange streams comprises the first portion of the first column bottoms stream, the second portion of the first column bottoms stream, the mixed stream, and the second column overhead stream downstream of the third heat exchanger.

48. The NRU system of claim 47 wherein the methane product stream comprises a high pressure sales gas stream having a pressure between 315 and 465 psia, an intermediate pressure sales gas stream having a pressure between 75 and 215 psia, and a low pressure sales gas stream having a pressure between 45 and 115 psia;

wherein high pressure sales gas stream is the first portion of the first column bottoms stream;

wherein the intermediate pressure sales gas stream is the second portion of the first column bottoms stream; and wherein the low pressure sales gas stream is the mixed stream.

49. The NRU system of claim 15 wherein the first feed stream and the second feed stream each comprise an amount of methane on a mole fraction basis that is higher than a total amount of heavier hydrocarbons; and wherein the second separator bottoms stream comprises an amount of methane on a mole fraction basis that is less than a total amount of the heavier hydrocarbons.

50. The NRU system of claim 1 further comprising a feed separator wherein a system feed stream comprising nitrogen, methane, and heavier hydrocarbons is separated into a feed separator overhead stream and a feed separator bottoms stream;

wherein the feed separator overhead stream comprises the first feed stream;

wherein the first feed stream comprises an amount of methane on a mole fraction basis that is higher than a total amount of heavier hydrocarbons; and wherein the feed separator bottoms stream comprises an amount of methane on a mole fraction basis that is less than a total amount of heavier hydrocarbons.

51. The NRU system of claim 14 wherein the methane product stream has a first volumetric flow rate and wherein the first column bottoms stream has a second volumetric flow rate that is more than 50% of the first volumetric flow rate.

* * * * *